United States Patent [19]

Ukai et al.

[11] Patent Number: 4,539,805

[45] Date of Patent: Sep. 10, 1985

[54] PROCESS AND APPARATUS FOR PRODUCING EASILY DYEABLE POLYESTER FALSE-TWISTED YARNS

[75] Inventors: Norio Ukai, Nobeoka; Katsushige Tomizuka, Takatsuki, both of Japan

[73] Assignee: Asahi Kasei Kogyo Kabushiki Kaisha, Osaka, Japan

[21] Appl. No.: 467,849

[22] Filed: Feb. 18, 1983

[30] Foreign Application Priority Data

Feb. 19, 1982 [JP] Japan ..... 57-24561
Aug. 7, 1982 [JP] Japan ..... 57-137611
Oct. 2, 1982 [JP] Japan ..... 57-172518

[51] Int. Cl.[3] ..... D02G 1/02; D02G 3/02

[52] U.S. Cl. ..... 57/290; 57/287; 57/288

[58] Field of Search ..... 57/247, 287, 288, 290

[56] References Cited

U.S. PATENT DOCUMENTS 3,695,026 10/1972 Taylor ..... 57/288 X
3,797,221 3/1974 Ikeda et al. ..... 57/247
3,910,027 10/1975 Bach et al. ..... 57/288
3,956,878 5/1976 Schaffer et al. ..... 57/290 X
4,019,311 4/1977 Schippers ..... 57/247 X
4,051,650 10/1977 Gleyze et al. ..... 57/290 X
4,081,948 4/1978 Parker ..... 57/290 X

*Primary Examiner*—Donald Watkins
*Attorney, Agent, or Firm*—Finnegan, Henderson, Farabow, Garrett & Dunner

[57] ABSTRACT

A false-twisted polyester yarn of good dyeing and mechanical properties is produced by a process wherein a yarn consisting of an as-spun polyester fiber having a mean birefrigence index ($\Delta n$) of from $15\times10^{-3}$ to $150\times10^{-3}$ is heat-treated and continuously, subjected to a false twisting treatment or draw-false twisting treatment. A preferred apparatus used comprises a feed yarn creel, a false twisting heater and an optional stabilizing heater, a false twisting element and a winder, wherein a heat-treating heater of the non-contact type is arranged upstream of the false twisting heater and between the false twisting heater and the feed yarn creel, at a height substantially equal to the height of the feed yarn creel so that the heat-treating heater confronts the false twisting heater; and a yarn cooling zone is provided between the heat-treating heater and the false twisting heater.

24 Claims, 17 Drawing Figures

PROCESS AND APPARATUS FOR PRODUCING EASILY DYEABLE POLYESTER FALSE-TWISTED YARNS

BACKGROUND OF THE INVENTION (1) Field of the Invention

This invention relates to a process and apparatus for producing false-twisted polyester yarns having enhanced tenacity, elongation and crimp stretchability and having such a good dyeability that dyeing can be accomplished under normal pressure with a disperse dye, by heat-treating a polyester yarn and continuously subjecting the yarn to false twisting.

(2) Description of the Prior Art

As a typical instance of the conventional process for false-twisting or draw-false-twisting polyester yarns, especially polyethylene terephthalate yarns, there can be mentioned a process disclosed in Japanese Unexamined Patent Application No. 48-35,112/73. A false-twisted yarn obtained according to this conventional process is excellent in various properties such as crimpability, tenacity, dimensional stability, heat resistance and wash-and-wear property and is utilized in various fields. However, polyethylene terephthalate fibers and false-twisted yarns thereof are poor in the dyeability and must be dyed at a high temperature such as about 130° C. Accordingly, it is necessary to employ a special apparauts for the dyeing operation, and furthermore, it is considerably limited that polyethylene terephthalate fibers are blended with fibers in which the physical properties are deteriorated by high-temperature high-pressure dyeing, such as wool, acrylic and Spandex fibers.

Attempts have been make to improve the dyeability of polyethylene terephthalate fibers and false-twisted yarns thereof for enabling these fibers and yarns to be dyed under normal pressure. For example, there is known a process using a dyeing accelerating agent called "carrier". This process, however, has several problems. For example, since the carrier is irritating and harmful to human bodies, the working environment of dyeworks is contaminated. It is difficult to dispose the waste dyeing solution. Furthermore, it often happens that dyeing specks called "carrier spots" are formed by insufficient emulsification of the carrier and the carrier remains in a dyed article to degrade the color fastness to light of the dyed article. Moreover, the carrier dyeing causes changes in the mechanical properties of polyethylene terephthalate fibers and false-twisted yarns thereof, for example, reduction of the tenacity and increase of the elongation.

It is known that the dyeability of polyethylene terephthalate can be improved by copolymerization with a metal sulfonate compound or a polyether. Although the dyeability is improved in this modified polyester, the modified polyester has problems in that polymerization or spinning is difficult, the mechanical and thermal properties possessed inherently by polyethylene terephthalate are degraded and the color fastness is reduced. Consequently, since a third component acting as a dye receptacle for dyeing the polymer is introduced for modifying the chemical properties of the polymer, reduction of heat resistance and mechanical properties possessed inherently by polyethylene terephthalate cannot be avoided by the improvement of the dyeability.

SUMMARY OF THE INVENTION

It is a primary object of the present invention to provide a process and apparatus for producing a false-twisted yarn of a polyester fiber having a practically sufficient tenacity and a good dyeability, i.e., capability of being dyed under normal pressure with a disperse dye without using a carrier. By the term "practically sufficient tenacity" used herein is meant a tenacity of at least 3.0 g/d, especially at least 3.5 g/d.

Another object of the present invention is to provide a process and apparatus by which false-twisted polyester yarn having a practically sufficient tenacity and a good dyeability can be produced in an industrially advantageous manner.

Other objects and advantages of the present invention will be apparent from the following description.

In accordance with one fundamental aspect of the present invention, there is provided a process for the production of a false-twisted polyester yarn, which comprises heat-treating a yarn consisting of an as-spun polyester fiber having a mean birefringence index ($\Delta n$) of from $15\times10^{-3}$ to $150\times10^{-3}$ and continuously, subjecting the heat-treated yarn to a false twisting treatment.

In accordance with another fundamental aspect of the present invention, there is provided a false twisting apparatus which comprises a feed yarn creel, a false twisting heater and an optional stabilizing heater, a false twisting element and a winder, wherein a heat-treating heater of the non-contact type is arranged upstream of the false twisting heater and between the false twisting heater and the feed yarn creel, at a height substantially equal to the height of the feed yarn creel so that the heat-treating heater confronts the false twisting heater; and a yarn cooling zone is provided between the heat-treating heater and the false twisting heater.

DETAILED DESCRIPTION OF THE PREFERRED EMBODIMENTS

The "polyester fiber" referred to in the present invention means a fiber consisting essentially of polyethylene terephthalate. This polyester can be prepared by any of the known polymerization processes, and additives customarily used for polyesters, such as delustering agent, a stabilizer and an antistatic agent, may be incorporated in the polyester used in the present invention. The polymerization degree is not particularly critical and may be within an ordinary fiber-forming range. Of course, the polyester may be a copolymer of ethylene terephthalate with a small amount, for example, up to 5% by weight, of a comonomer, so far as the objects of the present invention can be attained.

The term "false twisting treatment" as used in the present invention means both (1) a false twisting treatment which is carried out without drawing or with drawing a draw ratio of up to 1.0 and (2) a so-called in-draw-false twisting treatment where false twisting is carried out while simultaneously effecting drawing (that is, false twisting carried out at a draw ratio of more than 1.0).

The filament of the polyester fiber yarn may have not only a truly circular section but also an ellipse section or a section provided with star-shaped periphery, so far as the objects of the present invention can be attained.

Figure 1:
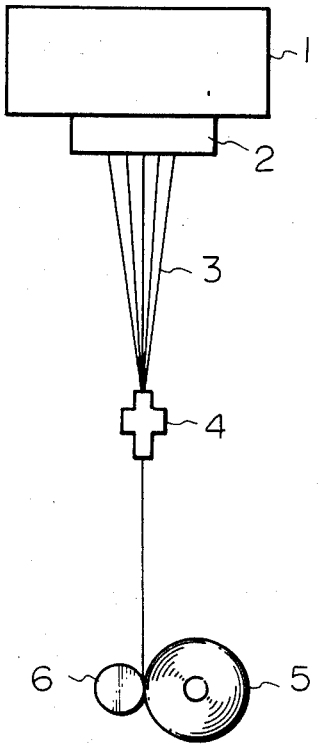
FIG. 1 is a diagram illustrating one embodiment of the spinning and winding device for a polyester yarn.

One of the characteristic features of the present invention is that an as-spun polyester fiber yarn having a mean birefringence index (Δn) of from $15\times10^{-3}$ to $150\times10^{-3}$ is used. This as-spun polyester fiber yarn can be obtained by performing the spinning and winding operation at a spinning speed of 2,500 to 10,000 m/min by using an apparatus as shown in FIG. 1. In FIG. 1, reference numerals 1, 2, 3, 4, 5 and 6 represent a spin head, a spinneret, a spun filament being solidified, a fluid sucking device for cooling and sucking a bundle of filaments being solidified, a wound yarn package and a friction roll rotated at the same surface speed as the winding speed, respectively.

By the term "spinning speed" is meant the surface speed of the winding friction roll 6 when the filaments are spun and wound according to the process as shown in FIG. 1.

The so-prepared polyester yarn having a mean birefringence index (Δn) of from $15\times10^{-3}$ to $150\times10^{-3}$ is directly heat-treated without being drawn.

The heat treatment of the present invention is accomplished, for example, by passing the fiber yarn spun at the above-mentioned spinning speed in a heated tubular or slit heater with no contact with the heater surface; passing the yarn through heated air or super-heated steam, or passing the yarn on a heater while contacting it with the heated metal plate according to certain conditions.

When the yarn is passed through the heated tubular or slit heater, the temperature of the heater is adjusted to 190° to 300° C. An optimum heat treatment temperature varies depending upon such factors as the Δn value of the fiber, the heat treatment time, the yarn feed ratio, the fineness of the single filament and the fineness of the yarn.

Since a polyethylene terephthalate homopolymer fiber having a Δn value of at least $50\times10^{-3}$ has a substantially completed fiber structure, when the fiber is passed through a tubular or slit heater maintained at a temperature of 220° to 300° C. over a period of 0.4 to 2 seconds while adjusting the yarn feed ratio in the range of from −10% to +4% during the heat treatment, the heat-treated yarn comes to have an increased degree of crystallinity and an increased refractive index. Namely, the fiber structure is more completed. Moreover, the structure of the amorphous region dominating the dyeability of the fiber is relaxed so that the fiber can be dyed even under normal pressure with a disperse dye. The dynamic loss tangent (tan δ)-temperature characteristic is suitable for defining the structure of the amorphous portion.

There have been reported several studies made on the relationship between the dyeability of a fiber with a disperse dye and the viscoelasticity of the fiber [for example, K. Kamide and S. Manabe, "Fine Structure of Amorphous Region of Fiber Revealed by Dynamic Dispersion", Sen-i Gakkaishi, 34, page 70 (1978)]. According to these studies, it is generally considered that the larger the value of tan δ relating to a mechanical absorption due to the microbrownian movement of the main chain and the lower the temperature of the mechanical absorption, the more improved the dyeability. According to our study, it has been found that parameters of a polyester fiber yarn before the false twisting treatment, which are preferred from the viewpoint of the fine structure, are as follows. Namely, the peak value of tan δ, i.e., $(\tan \delta)_{max}$, in the tan δ-temperature curve is at least 0.10, the temperature $T_{max}$ at which tan δ shows a peak is not higher than 115° C., the value of tan δ at 220° C., i.e., $\tan \delta_{220}$, is not more than 0.055, the value of degree of crystallinity (χc) is at least 50% and the value of Δn is at least $35\times10^{-3}$. If a fiber having such parameters is subjected to the false twisting treatment, a fiber dyeable under normal pressure can be obtained. An as-spun polyester fiber spun at a spinning speed of less than about 4,500 m/min have the $(\tan \delta)_{max}$ and $T_{max}$ values falling within the above-mentioned ranges, but $\tan \delta_{220}$ exceeds 0.055 and both or either of χc and Δn is lower than the above lower limit and the mechanical properties are low and the stability against heat is insufficient. If this polyester fiber is subjected to the false twisting treatment, the structure is greatly changed by influences of heat received during the treatment, $(\tan \delta)_{max}$ becomes smaller than 0.14 and $T_{max}$ becomes higher than 130° C., and the false-twisted yarn cannot be dyed under normal pressure.

The polyester yarn heat-treated according to the process of the present invention is characterized as possessing a $(\tan \delta)_{max}$ value of at least 0.10, a $T_{max}$ value not higher than 115° C., a $\tan \delta_{220}$ value not more than 0.055, a χc value of at least 50% and a Δn value of at least $35\times10^{-3}$, and even after the false twisting treatment, the polyester yarn can be dyed under normal pressure.

The conditions of the heat treatment of an as-spun fiber spun at a spinning speed of 4,000 to 10,000 m/min for obtaining an easily dyeable polyethylene terephthalate fiber yarn having the above-mentioned fine structure are as described hereinbefore, when the fiber yarn is passed through a tubular or slit heater. In the process of the present invention in which the false twisting treatment is carried out successively after the heat treatment, from the viewpoints of the time required for the false twisting, the capacity of the apparatus and the properties and quality of the obtained false-twisted yarn, it is preferred that the heater temperature be 230° to 270° C., more preferably 240° to 260° C., the heat treatment time be 0.4 to 1.5 seconds, more preferably 0.6 to 1.3 seconds, and the fiber feed ratio be −3 to +8%, more preferably −1 to +6%.

Figure 4:
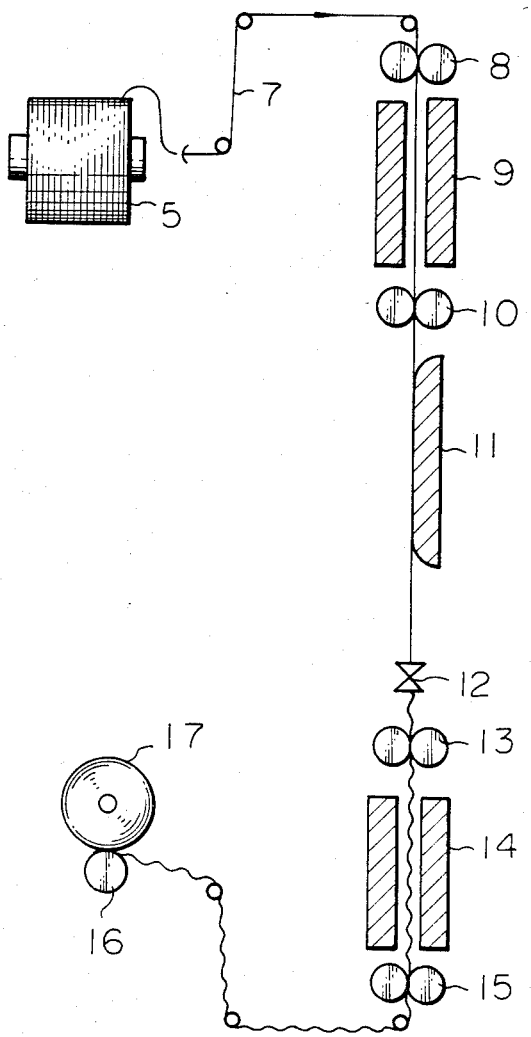
FIG. 4 is a diagram illustrating one embodiment of the process of the present invention, in which the yarn is heat-treated by a heat-treating heater of the non-contact type.

The process of the present invention is ordinarily carried out by using an apparatus of the type shown in FIG. 4.

As ordinary means for heating the fiber yarn, there can be mentioned a dry heat treatment conducted in the dry state and a wet heat treatment conducted in a wet and hot atmosphere. Any of the heat-treating methods can be adopted in the present invention. However, in the process of the present invention, in which the false twisting treatment is carried out subsequently to the heat treatment without winding of the yarn (i.e., without interruption of the yarn travelling) after the heat treatment, the dry heat treatment is especially advantageous. By the term "wet heat treatment in a wet and hot atmosphere" used herein is meant a treatment conducted in super-heated steam or a mixture of super-heated steam and hot air. It is preferred that the wet heat treatment be carried out at a temperature in the range of from (230°-50Z)° C. to (290°-50Z)° C., in which Z stands for a mole fraction of steam in the atmosphere.

It is ordinarily preferred that at the heat treatment, the yarn be heated in the non-contact state where the yarn is not contacted with the surface of the heat-treating heater.

In order to obtain a sufficient normal pressure dyeability and a good adaptability to the heat treatment and the false twisting, it is preferred that the heat treatment of the polyester yarn be carried out at a feed rate of 0 to S % in which S stands for the shrinkage (%) in boiling water (S>0). If the feed ratio exceeds the shrinkage (S %) in boiling water, the heating operation becomes very difficult, with the result that the yarn finishing capability, especially the yarn finishing capability at the continuous operation, is reduced, and the dyeability is degraded and fluffs are readily formed.

When the polyester yarn is heat-treated, from the viewpoint of the normal pressure dyeability of the obtained yarn and in order to control formation of fluffs, it is especially preferred that the temperature of the polyester filament yarn per se be maintained at a level higher than 200° C. A method suitable for performing the heat treatment under such conditions comprises passing a polyester filament yarn through a tubular or slit heater having a heater surface temperature of at least 250° C. over a period of at least 0.4 second.

The structure of an as-spun polyester fiber having a Δn value of at least $15\times10^{-3}$ but less than $50\times10^{-3}$ is not completed. In the present invention, in case of such an uncompleted fiber, it is indispensable that the fiber be drawn by 5 to 200% in the step of the heat treatment. If the heat treatment is carried out without effecting this drawing, crystals are not sufficiently grown or developed, and therefore, the fiber is partially fused and the mechanical properties are drastically degraded.

However, if the above-mentioned fiber is heat-treated while drawing it by 5 to 200%, fusion of the fiber is not caused, and there is obtained a fiber which can advantageously be subjected to the false twisting treatment in the present invention, and which are characterized as possessing a $(\tan \delta)_{max}$ value of at least 0.10, a $T_{max}$ value of not higher than 115° C., a $\tan \delta_{220}$ value of not more than 0.055, an χc value of at least 50% and a Δn value of at least $50\times10^{-3}$.

The temperature to be adopted for heat-treating a polyester fiber yarn spun at a spinning speed of at least 2,500 m/min but less than 4,000 m/min may be the same as the temperature to be adopted for heat-treating a polyethylene terephthalate homopolymer fiber yarn spun at a spinning speed of at least 4,500 m/min. However, if the heat treatment is carried out in a tubular heater or in heated air, it is preferred that the heat treatment temperature be in the range of 190° to 270° C., more preferably 200° to 260° C.

Figure 5:
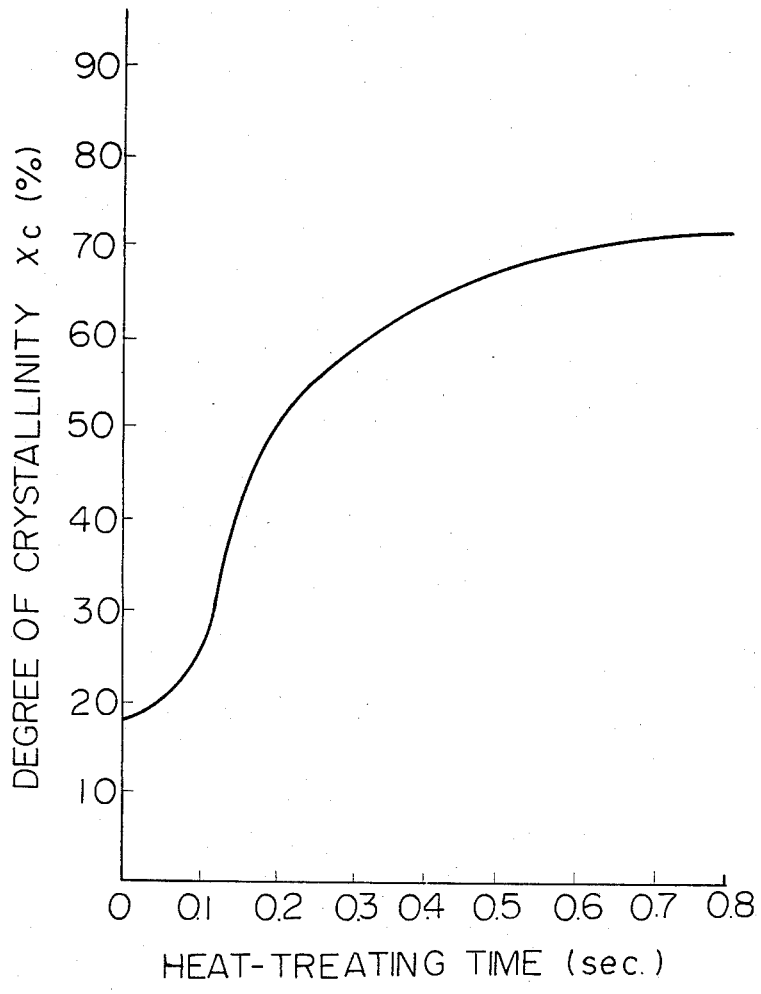
FIGS. 5 and 6 are graphs illustrating the relationship between the heat treatment time and the degree of crystallinity ($\chi c$ %) of a polyethylene terephthalate fiber and the relationship between the heat treatment time and $(\tan\delta)_{max}$ and $T_{max}$ (°C.), respectively, which are observed when a polyethylene terephthalate fiber spun at a spinning speed of 3,500 m/min is heat-treated in air maintained at 260° C. at a feed ratio of −12%, each numerical value in FIG. 6 representing the heat treatment time (seconds)
Figure 6:
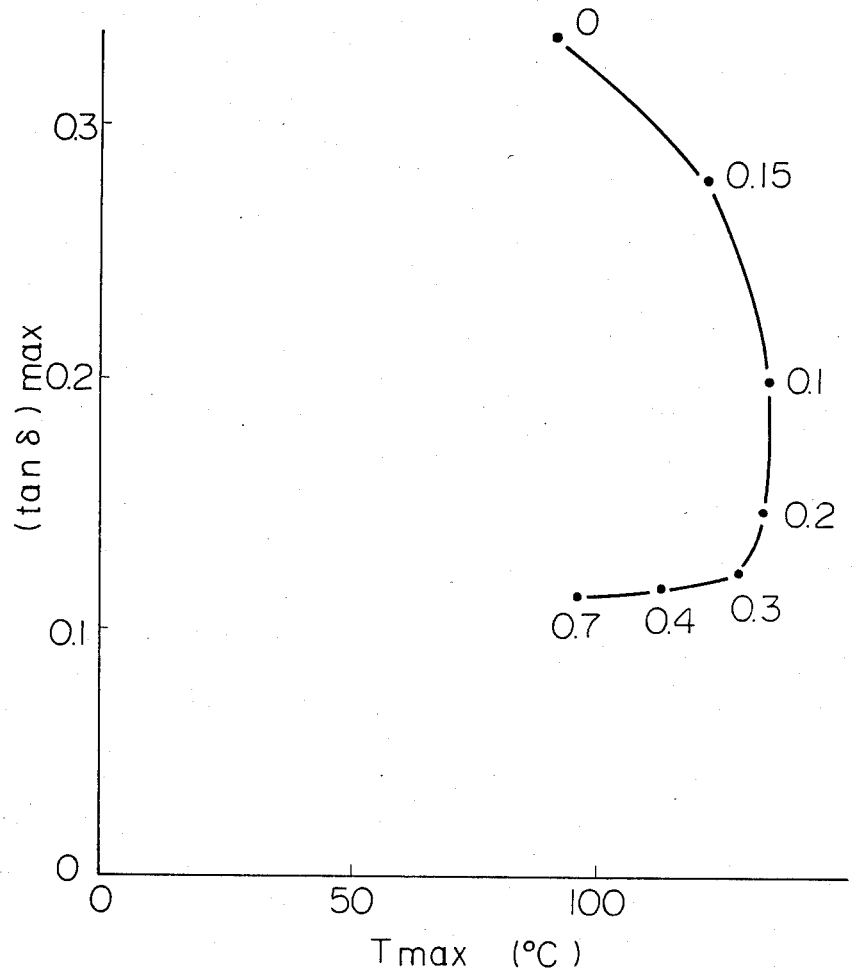

FIG. 5 illustrates the relationship between the heat treatment time (seconds) and the χc value (%) of the fiber, which is observed when a polyethylene terephthalate homopolymer fiber spun at a spinning speed of 3,500 m/min is heat-treated in air heated at 260° C. under an elongation of 12%. From FIG. 5, it is seen that the χc value is increased as the treatment time is prolonged and if the heat treatment time is 0.2 second, the χc value is substantially equal to the χc value of the fiber spun at a spinning speed of 4,000 m/min, that is, 50%. It also is seen that the χc value is gradually increased with prolongation of the treatment time and the χc value is 72% if the treatment time is 0.77 second. FIG. 6 illustrates the relationship of the treatment time to $(\tan \delta)_{max}$ and $T_{max}$ values, which is observed when the above-mentioned fiber is heat-treated in the same manner as described above. The numerical values in FIG. 6 represent the heat treatment time (second). From FIG. 6, it is seen that with prolongation of the treatment time, $(\tan \delta)_{max}$ decreases but $T_{max}$ increases, and that if the treatment time is 0.2 to 0.3 second or longer, $(\tan \delta)_{max}$ changes only to a minor extent but $T_{max}$ decreases. Namely, the heat treatment time region of up to 0.2–0.3 second is the region causing the structural change conventionally considered to be due to the heat treatment, that is, the region where the structure is made dense by the heat treatment. If the heat treatment time is further prolonged beyond the above region, crystals are developed but the amorphous portion is relaxed. Accordingly, in case of a polyester fiber yarn spun at a spinning speed of at least 2,500 m/min but less than 4,000 m/min, it is necessary that the heat treatment time should be longer by at least 0.2 second than the heat treatment time for the polyester fiber spun at a spinning speed of at least 4,000 m/min, and thus, it is preferred that the polyester fiber be heat-treated for 0.4 to 2.0 seconds.

Incidentally, the tan δ-temperature characteristics and the methods for measuring χc and Δn will be described hereinafter.

The foregoing heat treatment conditions are those for an ordinary polyester fiber in which the section of the filament has a circular shape and the size of the single filament is at least 1 denier. In case of a polyester fiber having a non-circular section such as a triangular or pentagonal section or a polyester fiber having a circular section but a size smaller than 1 denier, since the outer periphery of the fiber per unit sectional area is larger than that of the above-mentioned ordinary fiber and the influence of heat on the fiber is increased, it is permissible that the heat treatment temperature may be lowered by about 5° to about 10° C. or the treatment time may be shortened by 0.1 to 0.2 second.

In the process of the present invention, the heat treatment may also be carried out in super-heated steam or a mixed atmosphere of super-heated steam and hot air. In this case, the heat treatment time and the fiber feed ratio during the heat treatment are the same as in case of the heat treatment conducted in the tubular or slit heater or heated air, but it is preferred that the heat treatment temperature be selected within the range of from (230°-50Z)° C. to (290°-50Z)° C. in which Z stands for the mole fraction of super-heated steam in the heat-treating medium. Since steam has a larger heat capacity than that of air and exerts a higher heat-treating effect on the fiber, even if the heat treatment temperature is lower than that adopted when the heat-treating medium consists of air alone, a satisfactory heat-treating effect can be attained.

Figure 2:
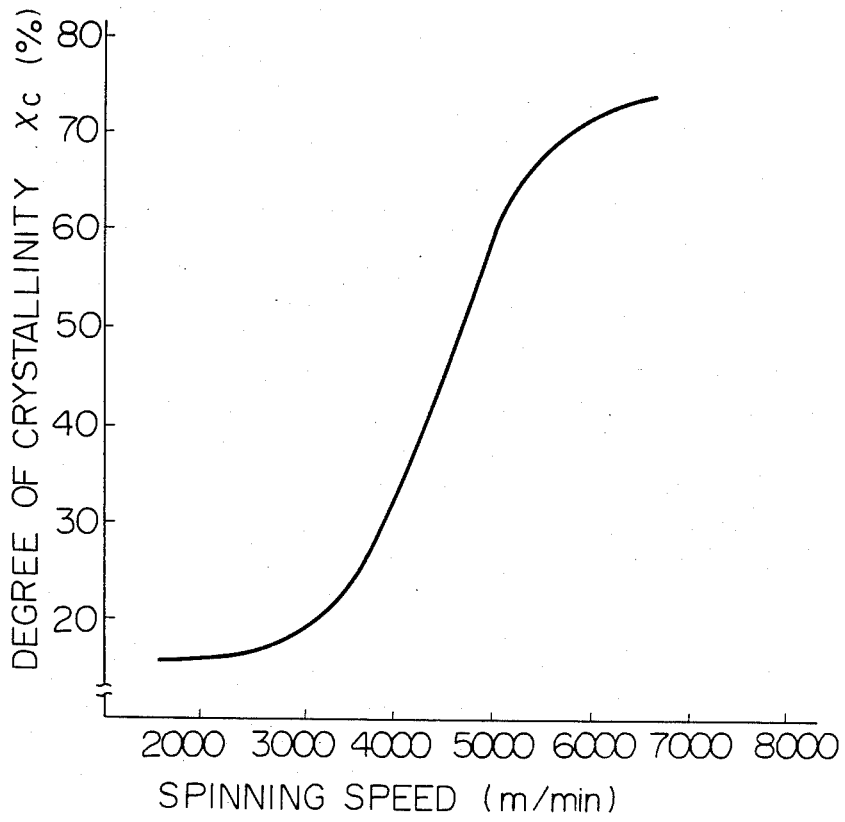
FIG. 2 is a graph illustrating the relationship between the spinning speed (m/min) and the degree of crystallinity ($\chi c$ %) of the yarn before the heat treatment.
Figure 3:
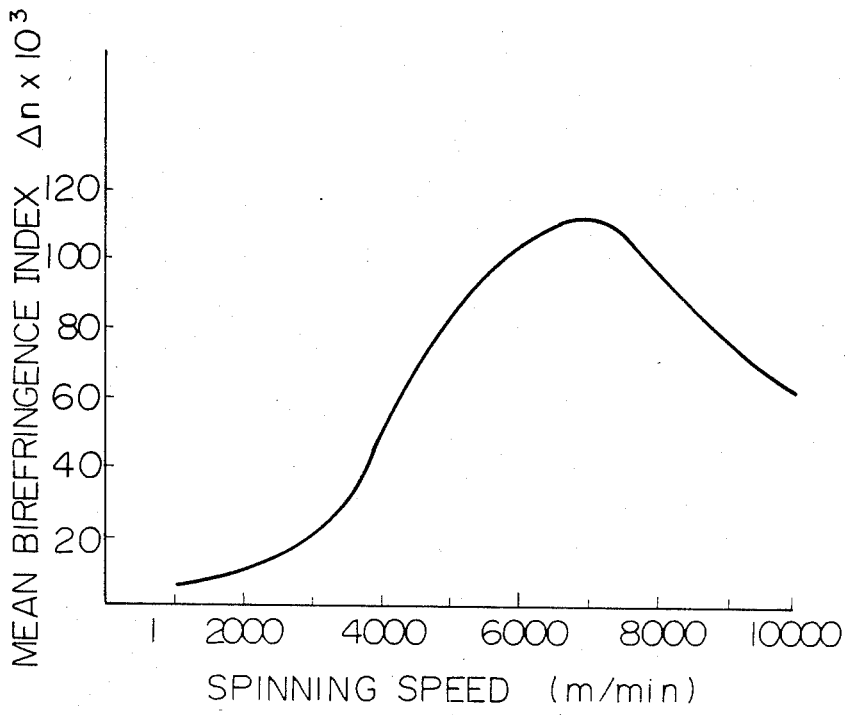
FIG. 3 is a graph illustrating the relationship between the spinning speed (m/min) and the mean birefringence index ($\Delta n$) of the yarn before the heat treatment.

The as-spun fiber having a Δn value of from $15\times10^{-3}$ to $150\times10^{-3}$, which is used in the present invention, can be obtained by performing the spinning operation according to the following method. For example, in a spinning apparatus as shown in FIG. 1, spinning is carried out at a winding speed of at least 2,500 m/min, that is, the spinning speed specified in the present invention. FIG. 3 shows the relationship between the spinning speed (m/min) and the Δn value of a 35-d/7-f multi-filament yarn having a filament section of a circular shape, which is obtained by spinning a polyethylene terephthalate homopolymer having an intrinsic viscosity of 0.63 dl/g as measured at 35° C. in a 2/1 mixed solvent of phenol/tetrachloroethane by using the spinning apparatus shown in FIG. 1. From FIG. 3, it is seen that the spinning speed providing a Δn value of $50\times10^{-3}$ is about 4,000 m/min and the spinning speed providing a Δn value of $15\times10^{-3}$ is about 2,500 m/min. FIG. 2 shows the relationship between the spinning speed (m/min) and the degree of crystallinity χc (%) determined from the X-ray diffraction curve, which is observed when spinning is carried out in the same manner as described above. From FIG. 2, it is seen that a polyethylene terephthalate fiber spun at a spinning speed of at least about 4,000 m/min, that is, a polyethylene terephthalate fiber having a Δn value of at least $50\times10^{-3}$, has a χc value of at least 50%, and the structure of the fiber is substantially completed. However, a polyethylene terephthalate fiber yarn spun at a spinning speed of at least about 2,500 but less than about 4,000 m/min may be regarded as an incomplete fiber in which the structure of the fiber is being formed. Accordingly, the polyester fiber having a Δn value of at least $15\times10^{-3}$ but less than $50\times10^{-3}$, that is, the polyester fiber yarn spun at a spinning speed of at least about 2,500 but less than about 4,000 m/min, is different from the polyester fiber having a Δn value of at least $50\times10^{-3}$, that is, the polyester fiber spun at a spinning speed of at least 4,000 m/min, and should be drawn at the heat treatment. A polyester fiber having a 66 n value smaller than $15\times10^{-3}$, that is, a polyeste fiber spun at a spinning speed of less than about 2,500 m/min, is composed substantially of an amorphous portion and the degree of orientation of the molecule chain is low. Therefore, if this polyester fiber yarn is subjected to the heat treatment according to the present invention, partial fusion is caused and the tenacity and elongation are extremely low.

When the polyester fiber yarn used in the process of the present invention is a polyester yarn composed of filaments having a circular section of a radius R in which the relations of $n_{\parallel(0)} \geqq 1.650$ and $[n_{\parallel(0.8)} - n_{\parallel(0)}] \geqq 5\times10^{-3}$ are established, supposing that the mean refractive index at the center of the circular section is $n_{\parallel(0)}$ and the mean refractive index at the point apart by 0.8 R from the center is $n_{\parallel(0.8)}$, fluffs are hardly formed during or after the treatment, and the crimp retention and dyeability are excellent.

In a polyester multifilament yarn which has conventionally been used for the false twisting treatment or draw-false twisting treatment, refractive indexes $n_{\parallel(0)}$ and $n_{\parallel(0.8)}$ described hereinafter are such that the relation of $n_{\parallel(0)} < 1.650$ or $[n_{\parallel(0.8)} - n_{\parallel(0)}] < 5\times10^{-3}$ is established. This polyester multifilament yarn has a problem in that fluffs are readily formed at the false twisting treatment. Especially in case of a polyester multifilament yarn having a small filament denier, for example, 2.7 denier or smaller, many fluffs are readily formed.

When the false twisting treatment is carried out while adjusting the draw ratio to a relatively low level so as to control formation of fluffs, the crimp retention of the obtained false twisted yarn is degraded though formation of fluffs is reduced.

In the polyester fiber yarn where the relationships of $n_{\parallel(0)} \geqq 1.650$ and $[n_{\parallel(0.8)} - n_{\parallel(0)}] \geqq 5\times10^{-3}$ are established, which is used in the present invention, the fiber structure is characteristic over the fiber structure of the polyester fiber yarn used in the conventional process in that the outer layer portion of the fiber has higher orientation and higher crystallinity but the central layer portion has lower orientation and lower crystallinity than the outer layer portion. When the heat treatment of the present invention is applied to the conventional yarn having the above-mentioned two-layer structure, this structure is changed so that the difference of the structure between the outer layer portion and central layer portion of the filament is reduced.

On the other hand, when a yarn having a structure characterized by the numerical parameters specified in the present invention is subjected to the heat treatment of the present invention to retain a dense structure of high orientation and high crystallinity in the outer layer portion of the fiber, even if the fiber is mechanically scratched by guides or the like at the subsequent false twisting treatment, the fiber is not damaged or broken because the dense hard outer layer portion protects the fiber, resulting in prevention of formation of fluffs.

The polyester yarn having the above-mentioned two-layer structure in which the relationships of $n_{\parallel(0)} \geqq 1.650$ and $[n_{\parallel(0.8)} - n_{\parallel(0)}] \geqq 5 \times 10^{-3}$ are established can be obtained by appropriately controlling such factors as the winding speed, the fiber denier, the cooling air temperature and the operation conditions of the fluid sucking device in the spinning apparatus shown in FIG. 1. Ordinarily, the two-layer structure yarn of the present invention is obtained when the winding speed is higher than 3,800 m/min, the cooling air temperature is lower than 15° C. and the size of the fiber during spinning and winding is finer than 2.1 deniers. Among these factors, the influence of the cooling air temperature is especially great, and a two-layer structure yarn can easily be obtained by lowering the cooling air temperature.

When a yarn composed of fibers having the above-mentioned two-layer structure is subjected to the false twisting treatment, since the central portion having a coarse structure shows a good heat-setting property, the crimp retention of the obtained false twisted yarn is highly improved over the crimp retention of the conventional false-twisted yarn.

It is preferred that the fiber yarn to be supplied be composed of fibers in which the distribution of local mean refractive indexes is symmetrical with respect to the center of the cross-section. The reason is that in this fiber yarn, the twisting stress is not concentrated on local parts of the fibers at the false twisting treatment and hence, tight spot occurs only to a negligible extent.

In the process of the present invention, the as-spun polyester filament yarn having a $\Delta n$ value in the range of from $15 \times 10^{-3}$ to $150 \times 10^{-3}$ may be heat-treated in the twisted state. In this case, it is preferred that the twist number be at least 3% of the twist number at the false twisting treatment. The twist number T at the false twisting treatment is 80 to 120% of $$\left(\frac{2300}{\sqrt{d}} + 590\right) t/m$$

in which d represents the denier of the false-twisted yarn, and this twist number is the number of twists present between the false twisting heater and the false twisting element. Of course, this twisted polyester fiber yarn may be heat-treated by passing it through the tubular heater without contact with the heater or by passing it through heated air, super-heated steam or a mixture thereof. However, if the spinning speed is at least 4,000 m/min, the resulting fiber yarn may be contacted with the heater during the heat treatment. In contrast, in case of an untwisted yarn, the contact with a heated metal plate or the like is not preferred because formation of fluffs or local fusion of the fiber cannot be avoided. Even in case of a twisted as-spun fiber, if the fiber is obtained at a spinning speed of less than 4,000 m/min, the structure of the fiber is incomplete as pointed out hereinbefore, fusion or formation of fluffs is readily caused, and therefore, it is not preferred to heat-treat the fiber while contacting it with a heated metal plate. In the case where a polyester fiber yarn spun at a spinning speed of at least 4,000 m/min is heat-treated in the twisted state while contacting it with a heated metal plate, even if the heat treatment is carried out at a high speed, the fibers of the yarn are not caught or rising of some filaments is not caused, and therefore, reduction of the operation adaptability can be avoided. Furthermore, in this case, since the heat conduction efficiency is improved, the heat treatment time can be shortened to about 0.2 second. Accordingly, the length of the heater can be shortened.

As the means for twisting the fiber yarn in this embodiment, there may be adopted a method in which the yarn is twisted before the heat treatment, but, when the false twisting treatment is conducted successively after the heat treatment and cooling as in the present invention, there may preferably be adopted a manner wherein twists given by the false twisting are extended to the heat treatment zone.

Figure 7:
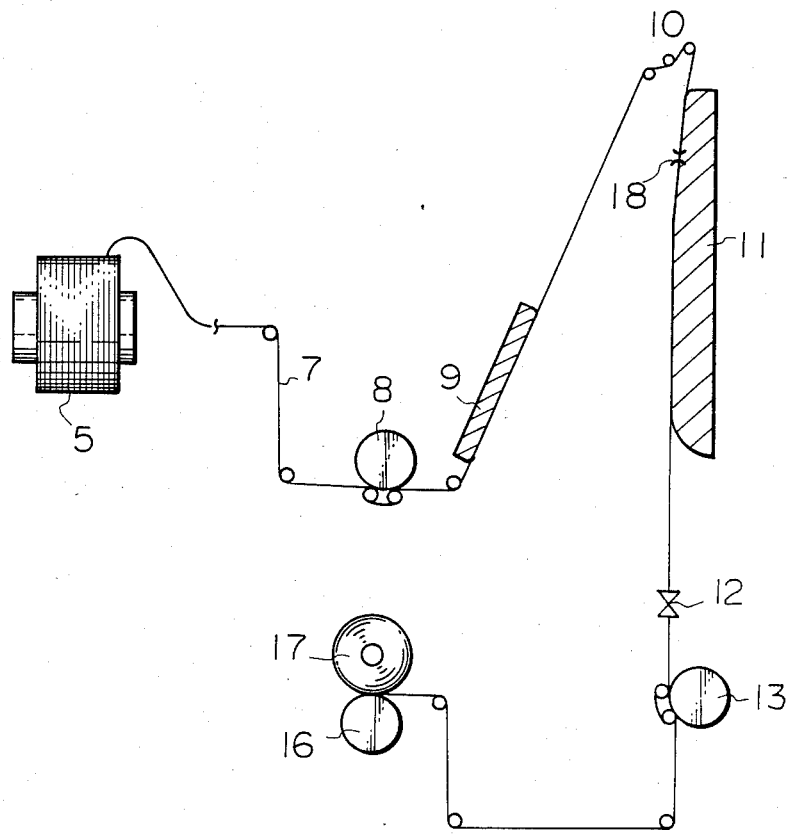
FIG. 7 is a diagram illustrating another embodiment of the process of the present invention in which a twisted yarn is treated by using a heat-treating heater of the contact type.
Figure 8:
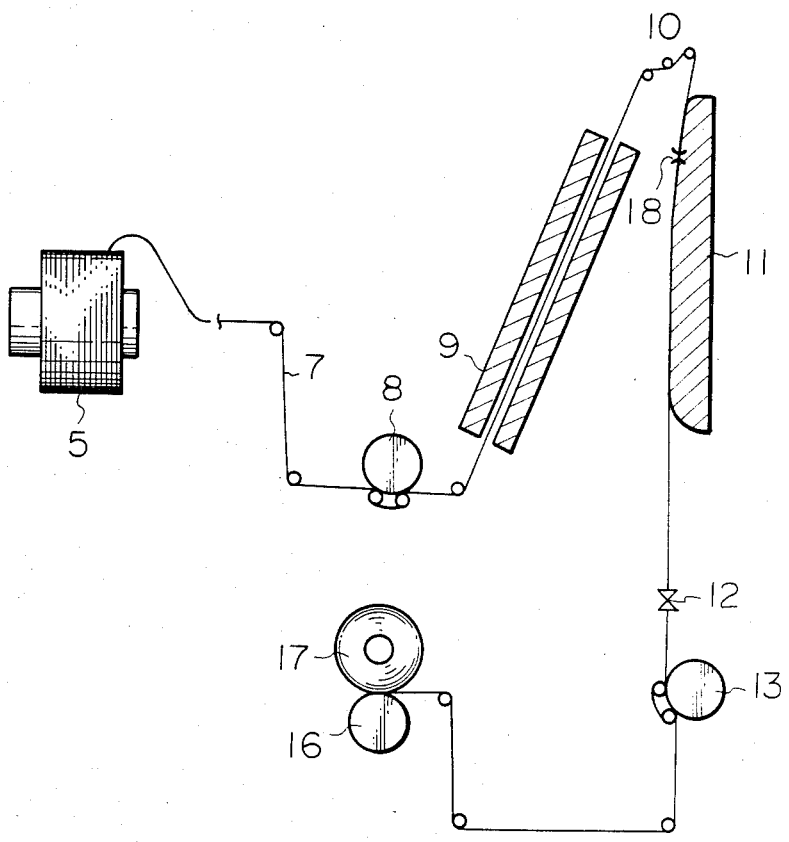
FIG. 8 is a diagram showing a modified embodiment of FIG. 7 where the treatment of a twisted yarn is carried out by using a heat-treating heater of the non-contact type.

FIGS. 7 and 8 illustrate embodiments in which the process of the present invention is carried out while twists given at the draw-false twisting step are extended to the heat treatment zone.

Referring to FIG. 7, a travelling yarn 7 unwound from a wound yarn package 5 is passed through a feed roller ($R_1$) 8 and through a heat-treating heater 9 provided with a metal plate while being contacted therewith. When the yarn 7 is passed through the heat-treating heater 9, twists propagated from a false twisting element 12 are given to the yarn 7. After the yarn 7 is heated in the heat-treating heater 9 in the twisted state, the yarn 7 is cooled by the atmosphere in the room and is guided into a false twisting heater 11 through a twist stop guide 10. If this cooling treatment is not effected and the twist stop guide 10 is not disposed, the drawing tension is extended into the heat-treating heater 9. In the false twisting heater 11, the yarn is heated to a temperature higher than the glass transition point to initiate drawing. The point at which drawing is initiated is the drawing point 18. After passage through the false twisting heater 11, the yarn is cooled again by the atmosphere in the room, and just after passage through the false twisting element 12, the yarn is untwisted and is then wound through a delivery roller 13 to form a package 17 of the drawn and false-twisted yarn. In FIG. 7, reference numeral 16 represents a winding friction roller ($R_3$).

FIG. 8 is a diagram illustrating another embodiment of the process of the present invention. The apparatus shown in FIG. 8 is the same as the apparatus shown in FIG. 7 except that the heat-treating heater 9 is of the non-contact heating type.

In the case where the heat treatment is carried out in the twisted state, the heat treatment temperature and fiber feed ratio are the same as those adopted in the heat treatment conducted in heated air. The heat treatment time may be shortened by about 0.2 second.

It is only when the polyester fiber yarn is passed through the drawing step after spinning that the Δn value of the polyester fiber yarn exceeds $150\times10^{-3}$, and any as-spun polyester fiber yarn cannot have a Δn value exceeding $150\times10^{-3}$. More specifically, as shown in FIG. 3, in case of the as-spun fiber yarn, the Δn value is at a peak when the spinning speed is about 7,000 m/min and the peak Δn value is about $120\times10^{-3}$. In the case where the fiber denier is smaller than 1 denier, since the draft ratio is increased at the spinning step, even an as-spun fiber yarn has a Δn value of more than that shown in FIG. 3 but the largest value is less than $150\times10^{-3}$.

Figure 16:
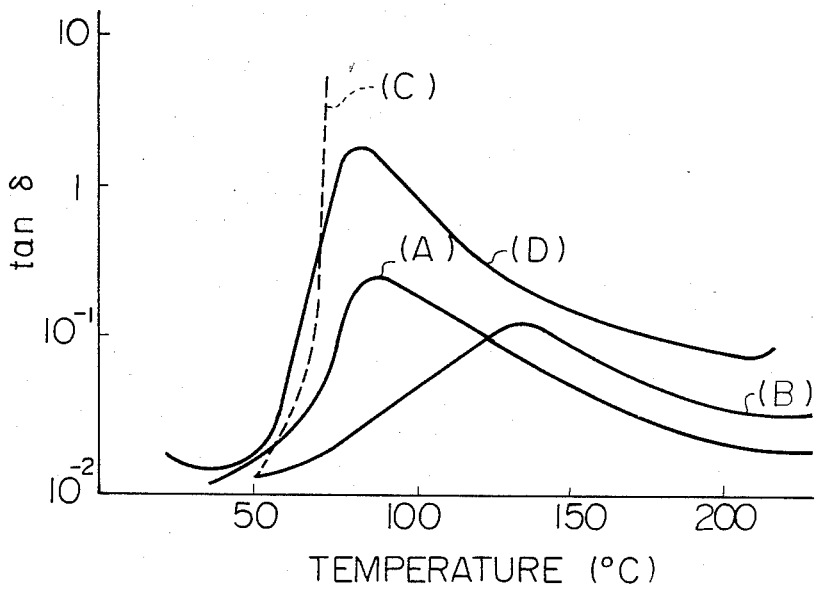
FIG. 16 shows a tan δ-temperature curve of a polyester fiber, in which the logarithms of tan δ are plotted on the ordinate and the temperatures (°C.) are plotted on the abscissa and in which (A) shows the false-twisted yarn obtained according to the process of the present invention, (B) shows the drawn yarn prepared according to the conventional process, (C) shows the as-spun yarn (i.e., undrawn yarn) spun at a spinning speed of 1,500 m/min and (D) shows the tan δ-temperature curve of the as-spun yarn (P.O.Y.) spun at a spinning speed of 3,000 m/min.

It is very difficult to prepare an easily-dyeable false-twisted polyester yarn from a polyester fiber yarn having a Δn value larger than $150\times10^{-3}$, that is, a polyester fiber yarn which has been drawn after the spinning step, according to a process similar to that of the present invention. In the yarn which has been drawn after the spinning step, the fine structure thereof, especially the structure of the amorphous region, is very dense and compact, and ordinarily, as shown in FIG. 16, the $(\tan\delta)_{max}$ value is about 0.1 and the $T_{max}$ value is at least 130° C. When it is intended to improve the dyeability of a spun and drawn polyester fiber yarn having a Δn value of more than $150\times10^{-3}$ by the heat treatment, it is necessary to relax the yarn by about 50% at the heat treatment, and in this case, even if the dyeability is improved, the mechanical properties are low and, for example, the tenacity is lower than 2.5 g/d. Moreover, uneven dyeing is readily caused in the longitudinal direction of the fiber yarn. Accordingly, it is practically impossible to prepare an easily-dyeable false-twisted polyester yarn from a polyester fiber having a Δn value of more than $150\times10^{-3}$ according to the process of the present invention.

When the polyester fiber yarn is subjected to the false twisting treatment after the heat treatment, it is preferred that an oiling agent be applied to the polyester fiber yarn prior to the false twisting treatment, because formation of fluffs or yarn breakage can drastically be reduced.

In the case where a polyester fiber yarn spun at a spinning speed of at least 2,500 m/min but less than 7,000 m/min is heat-treated and subsequently subjected to the false twisting treatment, if the yarn is cooled after the heat treatment and before the false twisting treatment, a false-twisted yarn having a practically sufficient tenacity and a very good dyeability can be obtained. Accordingly, it is preferred that cooling be effected after the heat treatment, though this cooling step is not indispensable if the heat treatment conditions are severe.

If the easily-dyeable structure formed in the heat-treating heater is set by cooling, this structure is not destroyed even when the yarn is then subjected to the false-twisting treatment. In contrast, if the yarn is subjected to the false twisting treatment before the easily-dyeable structure is not sufficiently set, the easily-dyeable structure is often destroyed and for this reason, it is considered that the dyeability of the false-twisted yarn is degraded.

Either natural cooling or forced cooling may be adopted for cooling the heat-treated yarn.

By the term "natural cooling", it is meant that the yarn is naturally cooled in the following manner. Ordinarily, the process of the present invention is carried out according to embodiments illustrated in FIGS. 7, 8, 9 and 4. In the embodiment illustrated in FIGS. 9 and 4, the yarn 7 travels in the room temperature atmosphere during the passage of from the slit heater 11 to the false twisting heater 11. In this embodiment, by the term "natural cooling", it is meant that the yarn 7 is cooled in the room temperature atmosphere while it travels from the outlet of the slit heater 9 to the inlet of the false twisting heater 11. Similarly, in the embodiment illustrated in FIGS. 7 and 8, the yarn 7 travels in the room temperature atmosphere during the passage of from the heater 9 to the false twisting heater 11. In this embodiment, by the term "natural cooling", it meant that the yarn 7 is cooled while it travels from the outlet of the slit heater 9 to the inlet of the false twisting heater 11.

Adoption of natural cooling is advantageous in that a cooling device need not be disposed and the deviation of the quality among lots can be reduced. In case of natural cooling, the cooling time (A) is important, and a good dyeability can always be attained if natural cooling is carried out so that the cooling time (A) satisfies the following requirement:

$$A \geqq \frac{7 - V}{4(V - 2.0)} \text{ (seconds)}$$

wherein V stands for the spinning speed (km/min) for the polyester yarn.

By the term "cooling time (A)" used herein is meant a time required for the yarn to travel from the outlet of the heat-treating heater to the inlet of the false twisting heater.

The reason why it is preferred that the treatment time (A) should satisfy the above requirement is as follows. As pointed out hereinbefore, in an as-spun polyester fiber yarn having a Δn value of at least $15\times10^{-3}$ but less than $50\times10^{-3}$, that is, a polyester yarn spun at a spinning speed of at least about 2,500 m/min but less than about 4,000 m/min, the χc value is small and the structure of the fiber is incomplete, and the yarn should be drawn in the heat treatment step. When the yarn is drawn in the heat treatment step, if the yarn is subjected to the false twisting treatment after the heat treatment without performing cooling, especially in case of a small draw ratio, the molecule chain of the fiber which has been drawn and oriented in the heat treatment step is relaxed and the mechanical properties are often reduced. Accordingly, in the case where the heat treatment is carried out under elongation, that is, in case of a fiber yarn spun at a spinning speed of at least about 2,500 m/min but less than about 4,000 m/min, cooling is especially preferred, and a relatively long cooling time is preferred. Drawing is not particularly necessary in case of a polyester fiber yarn having a Δn value of at least $50\times10^{31\ 3}$, that is, a polyester fiber yarn spun at a spinning speed of at least about 4,000 m/min. In this case, the lower the spinning speed, the less the relaxation of the amorphous region caused by the heat treatment, and the higher the spinning speed, the larger the relaxation of the amorphous region caused by the heat treatment. Accordingly, when the spinning speed is higher, the improvement of the dyeability by the heat treatment is increased. The reason is that in the as-spun polyester fiber yarn spun at a spinning speed of at least about 4,000 m/min, the higher the spinning speed, the more relaxed the amorphous region, and the dyeability is accordingly improved. Even this as-spun fiber, however, cannot be dyed under normal pressure before the heat treatment of the present invention.

As is seen from the foregoing description, in case of the as-spun fiber yarn spun at a spinning speed of at least about 4,000 m/min, a higher spinning speed results in a better dyeability, and therefore, the tendency of the change of the structure in the fiber during the period of from the termination of the heat treatment to the initiation of the false twisting treatment is smaller as the spinning speed is higher. Accordingly, in the case where the easily-dyeable structure formed at the heat treatment step is set by cooling, a longer cooling time becomes necessary as the spinning speed is lower. If the yarn is sufficiently cooled after the heat treatment, the easily-dyeable structure of the amorphous region formed by the heat treatment is set. If cooling is not sufficient, this setting is often insufficient, and if the yarn is subsequently guided to the false twisting step in the state where the easily dyeable structure is still incomplete, the easily dyeable structure being set is destroyed at the false twisting step. In case of a yarn where the easily dyeable structure is completed by cooling after the heat treatment, even if the yarn is successively guided to the false twisting step, the good dyeability of the false-twisted yarn is maintained at a high level.

If the spinning speed V for the yarn in the above formula illustrating the relation between the cooling time (A) and the spinning speed (V) is higher than 7 km/min, no cooling time becomes necessary.

Incidentally, if the heat treatment temperature is elevated, the good dyeability can be improved while reducing the value A of the cooling time. However, in this case, the tenacity of the obtained false twisted yarn is lower than 3.0 g/d. In order to obtain a false twisted yarn excellent in both the good dyeability and the tenacity, it is necessary that the requirement $$A \geqq \frac{7 - V}{4(V - 2.0)} \text{ (seconds)}$$

should be satisfied.

Ordinarily, by the term "natural cooling" is meant cooling conducted in a room temperature atmosphere, and the temperature of the room temperature atmosphere is in the range of 20° C.±15° C.

In case of forced cooling, the cooling time is shorter than in natural cooling, and forced cooling is advantageous in that the speed of the yarn can be increased and the structure of the treating apparatus can be made compact.

By "forced cooling" is meant cooling to be conducted by using any apparatus or device for increasing the cooling effect and shortening the cooling time. From the viewpoint of the cooling effect, a lower cooling temperature is preferred, and ordinarily, it is preferred that forced cooling be carried out at a temperature lower than the level causing dewing resulting in yarn unevenness, for example, at a temperature lower by 5° to 10° C. than room temperature. As the forced cooling method, there can be mentioned a method in which a cold plate maintained at a temperature lower by 5° to 10° C. than room temperature is inserted, for example, between the slit heater 9 and first feed roller ($R_1$) 10 shown in FIG. 9, and a method in which air maintained at a temperature lower by 5° to 10° C. than room temperature is blown against the yarn 7 while it travels from the outlet of the slit heater 9 to the inlet of the false twisting heater 11. Of course, the effect attained by forced cooling is the same as the above-mentioned effect attained by natural cooling.

The polyester fiber yarn which has thus been heat-treated or heat-treated and subsequently cooled is continuously subjected to the false twisting treatment.

The false twisting system employed may be any of the conventional pin type, friction type and apron nip type false twisting systems. It is preferred that the twist number be about 80 to about 120% of $$\left(\frac{23000}{\sqrt{d}} + 590\right) t/m,$$

in which d stands for the calculated denier of the fiber yarn after the false twisting treatment, and that the temperature of the false twisting heater be 180° to 240° C. However, it is preferred that the heater temperature at the false twisting treatment be lower than the heat treatment temperature. If the heater temperature at the false twisting is higher than the temperature of the preceding heat treatment, it happens that the easily-dyeable structure of the fiber formed at the heat treatment and set at the cooling treatment is greatly changed to a structure of a poor dyeability. Of course, even if the heater temperature at the false twisting treatment or draw-false twisting treatment is lower than the heat treatment temperature, the structure of the fiber is changed more or less, but the good dyeability is not degraded at all.

Whether or not the polyester fiber heat-treated and subsequently cooled is drawn at the false twisting step in the present invention is determined according to the elongation at break of the fiber after cooling. If the elongation at break of the fiber after cooling exceeds 30%, drawing is effected at the false twisting treatment. In contrast, if the elongation at break of the fiber is not more than 30%, the fiber is ordinarily overfed. As the elongation is high, the draw ratio is increased. The elongation at break of the fiber after cooling is changed according to the spinning speed and the heat treatment conditions, and ordinarily, a higher spinning speed, a higher heat treatment temperature and a higher fiber feed ratio at the heat treatment result in a lower elongation at break.

Of course, there may be adopted a method in which a stabilizing heater is used at the false twisting treatment to effect heat setting of the false-twisted yarn.

The fine structure of the false-twisted yarn obtained according to the above-mentioned process of the present invention is characterized in that the amorphous region is relaxed. Namely, the $(\tan \delta)_{max}$ value determined from the tan δ-temperature curve is at least 0.08 and the relationship of $(\tan \delta)_{max} \geqq 1 \times 10^{-2} (T_{max} - 105)$ is established. The false-twisted polyester fiber yarn having the above-mentioned structure for the amorphous region is rendered easily dyeable and capable of being dyed under normal pressure with a disperse dye. By the term "capable of being dyed under normal pressure", it is meant that the amount of the dye adsorbed when the false-twisted yarn obtained according to the process of the present invention is dyed at 100° C. for 60 minutes is equal to or larger than the amount of the dye adsorbed when a yarn obtained by subjecting a conventional drawn yarn of a polyethylene terephthalate homopolymer to a customary false twisting treatment is dyed at 130° C. for 60 minutes. This property is evaluated according to a method described below. Incidentally, in the conventional false-twisted polyester yarn, the $(\tan \delta)_{max}$ value is about 0.10 and $T_{max}$ value is 130° to 140° C., and this false-twisted yarn cannot be dyed under normal pressure.

In the process of the present invention, the draw-false twisting treatment is ordinarily carried out according to the method shown in FIG. 4. Namely, a travelling yarn 7 unwound from a wound yarn package 5 is heated between first feed rollers ($R_1$) 10 and a false twisting heater 11 (ordinarily, a heater of the contact type), and the yarn 7 is passed through a false twisting element 12, first delivery rollers ($R_2$) 13, a stabilizing heater (heater of the non-contact type) 14 and second delivery rollers ($R_3$) 15 in succession and then wound to form a package 17 of the drawn and false-twisted yarn. Incidentally, reference numeral 16 represents a winding friction roller ($R_4$).

The process of the present invention will now be described with reference to embodiments illustrated in the accompanying drawings.

FIG. 4 is a diagram illustrating one preferred embodiment of the heating and draw-false twisting (or false twisting) steps in the process of the present invention. Referring to FIG. 4, a yarn 7 unwound from a package 5, which is to be treated according to the present invention, is heat-treated while it travels through the central portion of a heater 9 disposed between second feed rollers ($R_0$) 8 and first feed rollers ($R_1$) 10 without being contacted with the heater 9. At this time, since the surface speeds of the second feed rollers ($R_0$) 8 and first feed rollers ($R_1$) 10 are set at certain levels, the yarn is heat-treated at a constant feed rate. In each of the constituent filaments of the yarn 7, the internal structure is changed as follows by this heat treatment. More specifically, in the outer layer portion having high orientation and high crystallinity, the orientation and crystallinity are further advanced and the structure is densified, while in the central layer portion having lower orientation and lower crystallinity than in the surface layer, the orientation and crystallinity are further reduced and the structure is coarsened.

The yarn in which the distinction between the two layers is thus rendered conspicuous by the heat treatment is then introduced into the false rollers ($R_1$) 10, a false twisting heater 11, a false twisting element 12 and first delivery rollers ($R_2$) 13. Even if the yarn is subjected to the false twisting treatment at this step, since the outer layer portion of the filament has a dense and compact structure, fluffs are not formed at all, and a false-twisted yarn having a very excellent crimp retention due to the coarse structure of the central layer of the filament can be obtained.

The fiber yarn just coming from the first delivery rollers ($R_2$) 13 has a very high stretchability but since the residual torque in the yarn is very large, the knitting property of the yarn is sometimes very poor. Accordingly, in order to remove the residual torque, the yarn may be passed through a stabilizing heater 14 in the non-contact state between the first delivery rollers ($R_2$) 13 and second delivery rollers ($R_3$) 15. After the torque has thus been reduced, the yarn is brought into contact with a winding friction roll ($R_4$) 16, whereby the false-twisted yarn is wound at a certain winding rate to form a package 17.

We made researches with a view to developing apparatuses for advantageously carrying out the process of the present invention, and it has been found thaa especially good results can be obtained by a false twisting apparatus which comprises a feed yarn creel, a false twisting heater or a false twisitng heater plus a stabilizing heater and a winder, wherein a heat-treating heater of the non-contact type is arrnaged upstream of the false twisting heater between the false twisting heater and the feed yarn creel at a height substantially equal to the height of the false yarn creel so taht the heat-treating heater confronts the false twisting heater. In this false twisting apparatus, it is preferred that the heat-treating heater be arranged at a height substantially equal to the height of the false twisting heater.

In an ordinary false twisting apparatus for a synthetic multifilament yarn, a false twisting heater, a false twisting element, an optional stabilizing heater and a winder are arranged in this order along a travel passage for a filament yarn taken out from a package on a feed yarn crrel. Recently, with increase of the false twisting speed, a yarn to be treated is pre-heated, or in order to obtain a variety of modified false-twisted yarns such as a fused yarn, a fluffy yarn and a distorted yarn, a yarn to be introduced into a false twisting zone is pre-heated by a heat-treating heater such as a hot plate or a hot roller and is then subjected to the false twisting treatment.

Figure 10:
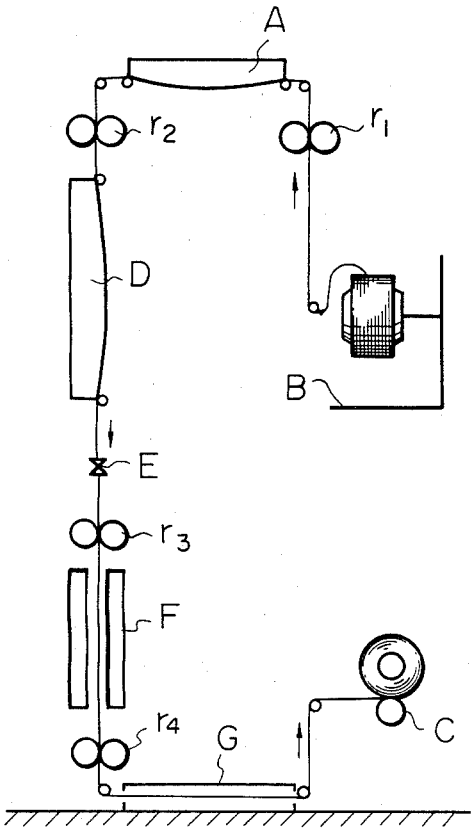
FIG. 10 is a diagram illustrating one example of the conventional false twisting apparatus provided with a pre-heating heater.

FIG. 10 is a diagram illustrating one example of a conventional false twisting apparatus provided with a heat-treating heater such as mentioned above. In another conventional false twisting apparatus which is the same as that shown in FIG. 10 except that the false twisting apparatus is not provided with a heat-treating heater A, in order to simplify the operation by a worker, a feed yarn creel B, a winder C, a false twisting heater D, a false twisting element E, a stabilizing heater F and feed rollers $r_1$ through $r_4$ are arranged on both the sides of an operation passage G. In the conventional false twisting apparatus provided with the heat-treating heater A as shown in FIG. 10, the heat-treating heater A is arranged above between the feed yarn creel B and the false twisting zone as shown in FIG. 10 so that the operation can be performed in the same manner as in the above-mentioned false twisting apparatus not provided with the heat-treating heater. In the conventional false twisting apparatus provided with the heat-treating heater, however, formation of fluffs or yarn breakage is frequently caused and no good adaptability to the false twisting operation can be obtained. Furthermore, a sufficient easy dyeability cannot be obtained, and the obtained false-twisted yarn is insufficient in the untwisting property, the level dyeing property and the yield of acceptable dyeing level. These defects are especially prominent when the heat treatment temperature is elevated or the length of the heat-treating heater is increased for enhancing the heat treatment effect. Recently, the operation speed of the false twisting treatment is increased or a variety of modified false twisted yarns differing in the function and form are prepared, and therefore, development of a false twisting apparatus provided with a heat-treating heater, in which the foregoing defects are eliminated, is eagerly desired.

We made basic studies on the false twisting process including the heat treatment with a view to meeting the above demand, and as the result, it has been found that the heat-treating heater attached in the upper portion complicates the heated air current in the vicinity of the false twisting apparatus and introduces the air current into the feed yarn creel to evaporate an oil from the feed yarn and that by re-adhesion of the evaporated oil to the running yarn and also by false twisting of the yarn in the insufficiently cooled state, the foregoing defects are caused. It has also been found that if the heat-treating heater is arranged at a specific position in a specific direction so that certain requirements are satisfied and if a yarn cooling zone is formed between the heat-treating heater and the false twisting heater, the above demand is completely met.

Thus, the false twisting apparatus of the present invention has been completed based on these findings, which apparatus comprises a feed yarn creel, a false twisting heater or a false twisting heater plus a stabilizing heater, a false twisting element and a winder, wherein a heat-treating heater of the non-contact type is arranged upstream of the false twisting heater and between the false twisting heater and the feed yarn creel, at a height substantially equal to the height of the feed yarn creel so that the heat-treating heater confronts the false twisting heater, and a yarn cooling zone is provided between the heat-treating heater and the false twisting heater.

The present false twisting apparatus will now be described with reference to embodiments illustrated in the accompanying drawings.

Figure 11:
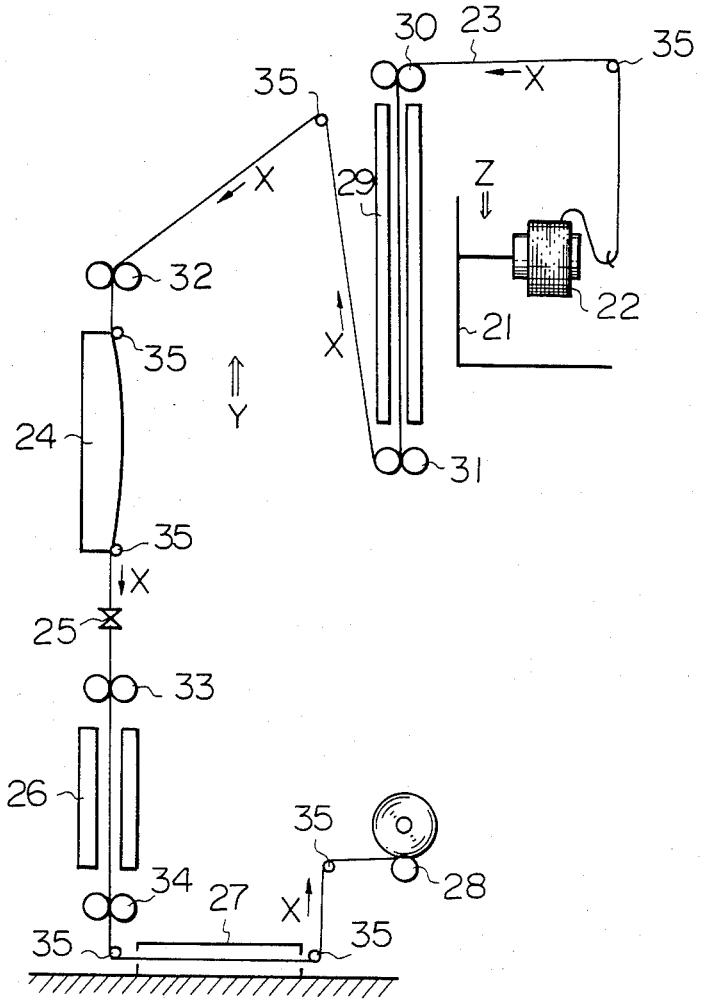
FIG. 11 is a diagram illustrating one embodiment of the false twisting apparatus of the present invention.
Figure 12:
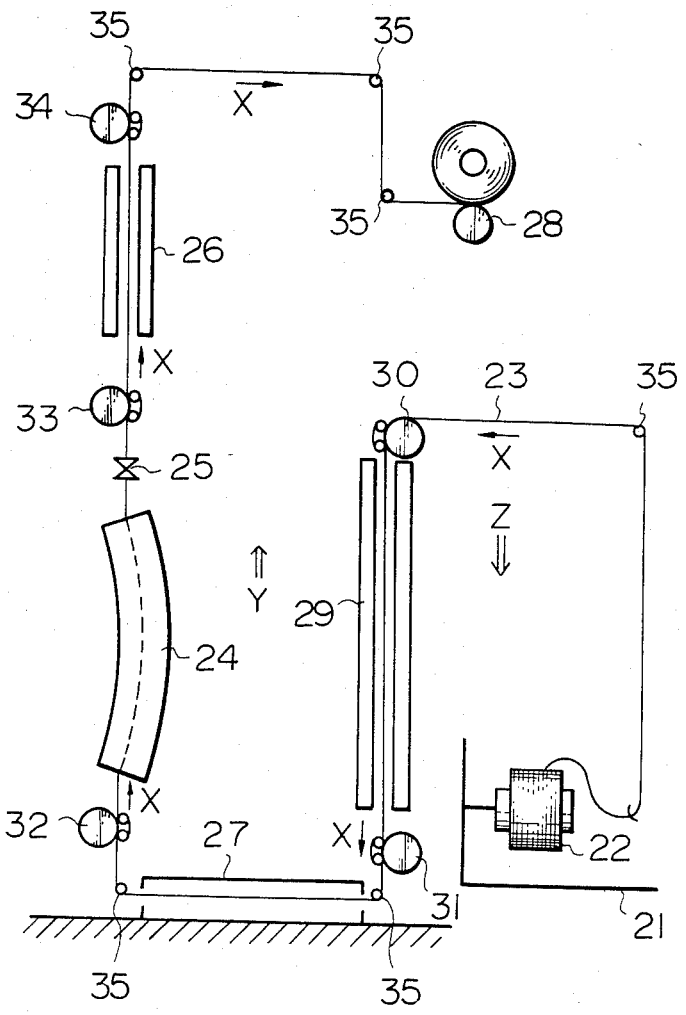
FIG. 12 is a diagram illustrating another embodiment of the false twisting apparatus of the present invention.

FIG. 11 is a diagram illustrating one embodiment of the present false twisting apparatus and FIG. 12 is a diagram illustrating another embodiment of the present false twisting apparatus. In the drawings, reference numeral 21 represents a feed yarn creel on which feed yarn packages 22 are mounted. A feed yarn 23 in the form of multifilaments is taken out from the feed yarn package 22.

The direction of the feed yarn creel 21 is opposite to the direction of the feed yarn creel in FIG. 10. However, this direction is not particularly critical, so far as the operation of exchanging feed yarn packages 22 on the feed yarn creel 21 is possible. Reference numeral 24 represents a false twisting heater for false-twisting the supplied yarn 23 in the heated state, and ordinarily, a hot plate or hot tube is used as the false twisting heater. A false twisting element 25 is disposed to give false twists to the supplied yarn 23. Reference numeral 26 represents a stabilizing heater for heat-setting the false twist-untwisted state in the supplied yarn 23, and ordinarily, a heater of the non-contact type is used as the stabilizing heater 26. In case of some kinds of synthetic fibers, this stabilizing heater 26 may be omitted. Reference numerals 27, 28 and 29 represent an operation passage, a winder and a heat-treating heater, respectively. As shown in FIGS. 11 and 12, the heat-treating heater 29 is arranged upstream of the false twisting heater 24 in the running passage of the yarn 23 indicated by arrow X between the false twisting heater 24 and the feed yarn creel 21 at a height substantially equal to the height of the feed yarn creel 21 so that the heat-treating heater 29 confronts the false twisting heater 24. If the heat-treating heater 29 is arranged so that the above-mentioned positional requirements are satisfied, important effects of the present invention are attained as described below. If the heat-treating heater 29 is arranged so that it confronts the false twisting heater 24, the operation can be facilitated by the provision of the operation passage 27 arranged below and between the two heaters 24 and 29. In this case, the heat-treating heater 29 and the feed yarn creel 21 are located on the same side with respect to the operation passage 27. If the position of the heat-treating heater 29 is thus specified, a yarn cooling zone can be formed between the outlet of the heat-treating heater 29 and the inlet of the false twisting heater 24. A heater of the non-contact type is used as the heat-treating heater 29. As the heater of the non-contact type, there are preferably used, for example, a groove-shaped heater in which a yarn is passed through a groove of a heater plate without being contacted therewith, a hollow pipe-shaped heater in which a yarn is passed through the hollow portion of the heater with no contact with the heater wall and a box-shaped heater having a relatively large size, through which a plurality of yarns are passed with no contact with the heater wall. Of course, other heaters of the non-contact type may be used. Since the heat-treating heater 29 is of the non-contact type, the heating efficiency of the heat-treating heater 29 is low. Accordingly, it is preferred that the length of the heat-treating heater 29 be equal to or larger than the length of the false twisting heater 24.

Feed rollers 30, 31, 32, 33 and 34 are rotated at predetermined peripheral speeds to allow the feed yarn 23 to travel and to give a predetermined drawing or relaxation to the yarn in a preset section. Guide pins 35 are disposed to allow the feed yarn 23 to travel along a predetermined course in co-operation with the feed rollers, while changing the running direction of the yarn 23.

In the false twisting apparatus of the present invention, effects described below are attained by dint of the above-mentioned structure. As is seen from the embodiments illustrated in FIGS. 11 and 12, the heat-treating heater 29 and false twisting heater 24 are arranged to confront each other, for example, with the operation passage 27 being interposed therebetween, as shown in the drawings. Accordingly, air above the operation passage 27, which is a space interposed between the two heaters 29 and 24, is heated by the heat radiated from both the heaters to form a rising air current in the direction indicated by arrow Y. Therefore, a descending current of cold air flowing in the direction of arrow Z is present on the side of the feed yarn creel 21 on the back of the heat-treating heater 29 and on the back side of the false twisting heater 24. Consequently, the feed yarn package 22 is not allowed to fall in contact with heated air but is rather cooled by cold air, and hence, an oil on the feed yarn is not evaporated and no change of the yarn quality is caused, with the result that at the subsequent false twisting step, formation of fluffs and occurrence of yarn breakage are minimized and a false-twisted yarn having excellent properties can be obtained. In the case where the heat-treating heater 29 is arranged to confront the false twisting heater 24 at the substantially same height, as shown in FIG. 12, the mist of the oil evaporated while the feed yarn 23 is passed through one heater does not adhere to the feed yarn 23 which is being passed through the other heater, and the feed yarn 23 stably travels in the state where an appropriate amount of the oil is uniformly applied to the feed yarn 23. Accordingly, a uniform false-twisted yarn free of untwisting irregularity, which is excellent in the dyeability, can be obtained according to the preferred embodiment shown in FIG. 12.

Definitions of the structural properties, mechanical properties, false twisting properties and other parameters of fibers and yarns used in the present invention and obtained yarns, and methods for determining these parameters, will now be described.

A. Mean Refractive Indexes ($n_{\parallel}$ and $n_{\perp}$) and Mean Birefringence Index ($\Delta n$):

According to the interference fringe method using a transmission quantitative type interference microscope (for example, an interference microscope "Interphako" manufactured by Carl-Zeiss Yena Co., East Germany), the distribution of the mean refractive index, observed from the side face of a fiber, can be determined. This method can be applied to fibers having a circular cross-section.

The refractive index of fibers is characterized by a refractive index $n_{\parallel}$ to polarized light having an electric field vector in the direction parallel to the fiber axis and a reflective index $n_{\perp}$ to polarized light having an electric field vector in the direction perpendicular to the fiber axis.

All the measurements described herein are performed by using green radiation (wavelength $\lambda=546$ mμ). The fiber to be tested is immersed in a sealing medium being inert to fibers and having a refractive index (N) giving a deviation of the interference fringe in the range of 0.2 to 2.0 times the wavelength by using optically flat slide glass and cover glass. Several fibers are immersed in the sealing medium so that the fibers are not in contact with one another. The fibers should be disposed so that the fiber axis is perpendicular to the optical axis of the interference microscope and the interference fringe. The pattern of the interference fringe is photographed and enlarged at about 1,500 magnifications for analysis.

Figure 15:
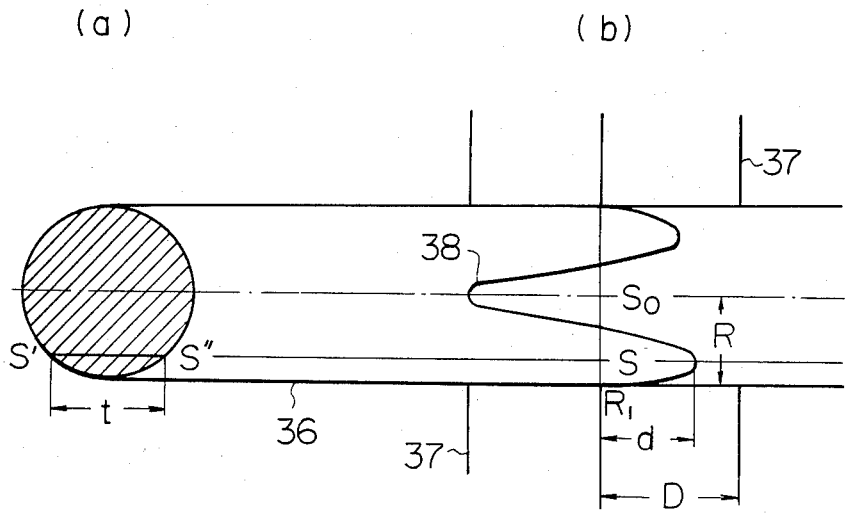
FIG. 15 is an example of an interference fringe pattern used for measuring the distribution of the refractive index ($n_{\parallel}$ or $n_{\perp}$) in the direction of the radius of the cross-section of a polyester fiber, in which (a) is a view showing the cross-section and (b) is a view showing an interference fringe pattern.

Referring to FIG. 15, the optical pass difference R is represented by the following formula:

$$R = \frac{d}{D}\lambda = [n_{\parallel} \text{ (or } n\perp) - N]t$$

wherein N is the refractive index of the sealing medium, $n_{\parallel}$ or ($n_{\perp}$) is the refractive index between the points S' and S'' on the periphery of the fiber, t is the thickness between the points S' and S'', λ is the wavelength of the radiation used, D is the distance (corresponding to 1λ) between parallel interference fringes of the background and d is the deviation of the interference fringe by the fiber.

From the optical path differences at respective portions in the range of from the center ($R_0$) of the fiber to the periphery ($R_1$) of the fiber, in which $R_1$ is the radius of the fiber, the distribution of the refractive index $n_{\parallel}$ or $n_{\perp}$ of the fiber at each portion can be determined. When r is the distance between the center of the fiber and each portion, the refractive index at the center of the fiber, i.e., $X=r/R=0$, is defined as the mean refractive index [$n_{\parallel(0)}$ or $n_{\perp(0)}$]. X is 1 at the position on the periphery of the fiber but X is a value of 0 to 1 at the other position of the fiber. For example, $n_{\parallel(0.8)}$ [or $n_{\perp(0.8)}$] the refractive index at the position of $X=0.8$. From the mean refractive indexes $n_{\parallel(0)}$ and $n_{\perp(0)}$, the mean birefringence index (Δn) is represented as $\Delta n=n_{\parallel(0)}-n_{\perp(0)}$.

Incidentally, in FIG. 15, reference numerals 36, 37 and 38 represent the fiber, the interference fringe by the sealing medium and the interference fringe by the fiber, respectively.

B. Shrinkage in Boiling Water:

The shrinkage (%) in boiling water is represented by the following formula:

$$\text{Shrinkage (\%) in water} = \frac{Lo - L}{Lo} \times 100$$

wherein Lo is the length of a sample under a load of 0.1 g/d, and L is the length of the sample under the same load after the treatment in boiling water for 30 minutes without the load.

C. Dynamic Mechanical Loss Tangent (tan δ):

The dynamic mechanical loss tangent (tan δ) can be measured by using an apparatus for measuring the dynamic viscoelesticity, manufactured by Toyo Baldwin, Rheo-Vibron DDV-IIc, at a frequency of 110 Hz in dry air at a temperature-elevating rate of 10° C./min.

A peak temperature ($T_{max}$) of tan δ and a peak value [$(\tan\delta)_{max}$] of tan δ are obtained from the tan δ-temperature curve. Typical instances of the tan δ-temperature curve are shown in FIG. 16, in which (A) is a curve of a false-twisted polyester yarn prepared according to the present invention, (B) is a curve of a conventional drawn fiber, (C) is a curve of an undrawn fiber spun at a spinning speed of 1,500 m/min and (D) is a curve of a partially oriented fiber spun at a spinning speed of 3,000 m/min.

D. Degree of Crystallinity (χc):

The χc value can be determined by measuring the X-ray diffraction intensity in the equatorial direction by the reflection method. The measurement is carried out by using an X-ray generator ("RU-200PL" manufactured by Rigaku Denki), a goniometer ("SG-9R" manufactured by Rigaku Denki), a scintillation counter and a pulse height analyzer. Cu-Kα (wavelength $\lambda=1.5418$ Å) monochromatized by a nickel filter is used for the measurement. A fiber sample is set in a sample holder composed of aluminum so that the fiber axis is perpendicular to the plane of the diffraction. The thickness of the sample is adjusted to about 0.5 mm.

The X-ray generator is operated at 30 KV and 80 mA. The diffraction intensity is recorded from 7° to 35° of 2θ at a scanning speed of 1°/min, a chart speed of 10 mm/min, a time constant of 1 second, a divergent slit of ½°, a receiving slit of 0.3 mm and a scattering slit of ½°. The full scale deflection of the recorder is set so that the entire diffraction curve remains on the scale.

Figure 17:
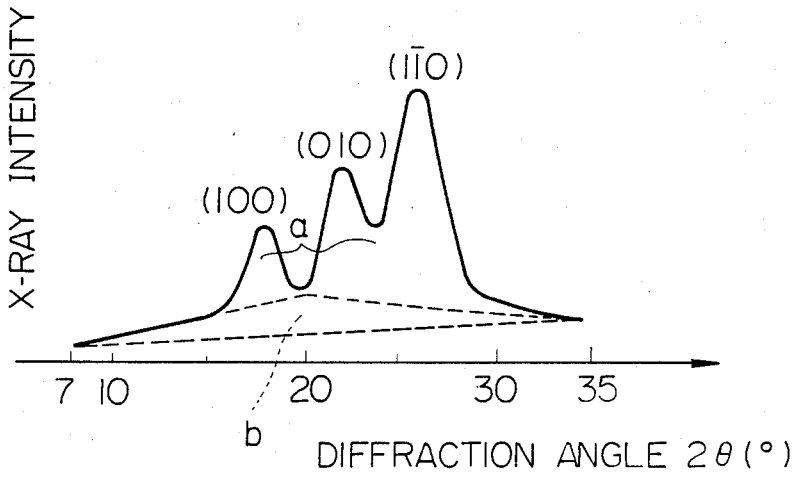
FIG. 17 is an example of the X-ray diffraction-intensity curve of a polyester fiber, in which (a) represents the crystalline region and (b) represents the amorphous region.

Generally, a polyethylene terephthalate fiber has three major reflections on the equatorial line in the range of from 17° to 26° of 2θ [at faces of (100), (010) and (1$\bar{1}$1). FIG. 17 is an example of the curve of the X-ray diffraction intensity of a polyethylene terephthalate fiber, in which (a) indicates a portion of the X-ray diffraction intensity attributed to the crystalline region and (b) indicates a portion of the X-ray diffraction intensity attributed to the amorphous region.

A base line is established by drawing a straight line between 7° and 35° of 2θ on the diffraction intensity curve. As shown in FIG. 17, the crystalline portion (a) and the amorphous portion (b) are separated by drawing a straight line along the tail of the lower angle and the tail of the higher angle from the peak point positioned near the angle of 20° of 2θ. The χc value is represented by an area analysis method according to the following equation:

$$\chi c\ (\%) = \frac{\text{scattering intensity of crystalline portion}}{\text{total scattering intensity}} \times 100$$

E. Dyeability:

The dyeability is evaluated by a dye up-take ratio. A sample is dyed with a disperse dye (Resolin Blue FBL supplied by Bayer AG) at a dye concentration of 3% owf and a liquor ratio of 1 to 50 at 100° C. Further, 1 g/l of a dispersing agent (Disper TL) is added to the dyeing solution and the pH value is adjusted to 6 by addition of acetic acid. After a predetermined period of time (i.e., one hour), the dyeing solution is sampled and the amount of the dye left in the dyeing solution is measured by the absorbance, and the amount of the dye taken up is calculated by subtracting the amount of the dye left in the dyeing solution from the amount of the dye used for the dyeing operation. The dye up-take ratio (%) is calculated from this amount of the dye taken up. The sample fiber is formed into a knitted fabric by using an one feeder circular knitting machine, and the fabric is scoured with 2 g/l of scourol FC-250 at 60° C. for 20 minutes, dried and conditioned at a relative humidity of 65% and a temperature of 20° C. for 24 hours, and the sample fabric is then tested.

When a typical conventional drawn and false-twisted polyester yarn is dyed under the above conditions at 130° C. for 60 minutes, the dye up-take ratio is 83%. If the dye up-take ratio of the sample is higher than 83%, it is judged that the dyeability of the fiber is good.

F. Threading Property:

The easiness in the threading operation is qualitatively judged according to the three-staged method. If the easiness in the threading operation is comparable to that in case of a conventional false-twisted polyester yarn, the sample is indicated by mark "A". If the sample is fused by contact with the tube heater or broken or fluffs are formed and the threading operation becomes very difficult, the sample is indicated by mark "B". A sample having a threading property intermediate between those of the above-mentioned two samples is indicated by mark "C".

G. Yarn Breakage:

Ordinarily, the yarn breakage is expressed by the frequency of yarn breaking caused when the operation is carried out in a false twisting machine having 216 spindles for one day. Accordingly, the unit is expressed by times/216 spindles × 1 hour. It is ordinarily preferred that the yarn breakage be smaller than 1.0 time.

H. Formation of Fluffs:

1 kg of a false-twisted yarn is wound up in a parallel cheese form, and the number of broken filaments present on both the end faces of the cheese is counted and the counted number is designated as the number of fluffs. Accordingly, the unit is expressed by fluffs/kg. If the number of fluffs is not smaller than 5.0 fluffs/kg, troubles are readily caused at the subsequent knitting or weaving step. Therefore, it is indispensable that the fluff number should be smaller than 5.0 fluffs/kg.

I. Tight Spots:

100 m of a false-twisted yarn is wound on a black plate, and 100 m of the same false-twisted yarn is on another black plate. The number of tight spots on the two plates is counted. When the average number on the two plates is 0, the sample is indicated by mark "A". If the average number is larger than 0 but not larger than 3, the sample is indicated by mark "B". If the number is larger than 3, the sample is indicated by mark "C". A sample indicated by mark A can be practically used in any field without any trouble, but in case of a sample indicated by mark B, fields of products to which the sample can be applied are limited.

J. Crimp Retention:

Of the crimp appearance ratios described in Japanese Unexamined Patent Publication No. 35,112/73, the $CD_{5.0}$ value is employed.

First, the $CD_{5.0}$ value of a textured yarn from the false twisting step is measured, and this value is designated as $\alpha$. Then, the textured yarn is immersed in boiling water at 100° C. under a load of 0.01 g/d for 1 minute. Then, the yarn is naturally dried at a temperature of 20° C. and a relative humidity of 60% in the free state without the load, and the $CD_{5.0}$ value is measured again. This value is designated as $\beta$. The crimp retention of the textured yarn is expressed by the following formula:

$$\text{Crimp retention } (\%) = \beta/\alpha \times 100$$

Ordinarily, if the crimp retention is at least 65%, it is judged that the crimp retaining property is good.

K. Tenacity and Elongation:

The tenacity and elongation are measured by using a tensile testing machine ("Tensilon UTM-II-20" manufactured by Toyo Baldwin) at an initial length of 20 cm and a tensile velocity of 20 cm/min. The initial length of 20 cm employed is the length of the crimp elongated.

L. Yield of Acceptable Dyeing Level

A standard yarn and sample yarns are knitted separately by using a one feeder knitting machine. The knitted fabrics are scoured under the same conditions as used in the test of dyeability (item E). After scouring, the standard fabric and the sample fabrics are dyed simultaneously in the same dyeing liquor. The dyeing condition are as follows.

Foron Navy S-GL 1% owf
(Dipserse dye, supplied by Sandoz SA, Switzerland)
Liquor ratio: 1 to 5
Dyeing temperature: 100° C.
Dyeing time: 60 min.

The dyed fabrics are dried and then the colour differences (tolerance indexes) between the standard fabric and the respective sample fabrics are measured. The yield (Y) of acceptable dyeing level is calculated by the following equation.

$$Y(\%) = \frac{\text{Number of the samples exhibiting colour difference of below 1 } NBS \text{ unit}}{\text{Total number of the samples tested}} \times 100$$

M. Evenness of Dyeing

Evenness of dyeing is evaluated on the knitted fabrics dyed by the procedure described in the preceding item L. and having a cylindrical form of four inches in diameter and one inch length. The colour differences (tolerance indexes) between the adjacent courses in each sample fabric are measured. Samples having the colour differences all falling below 1 NBS unit are indicated by mark "good". Samples in which at least a colour difference exceeding 1 NBS unit has been observed are indicated by mark "poor".

The present invention will now be described in detail with reference to the following Examples that by no means limit the scope of the invention.

EXAMPLE 1

Polyethylene terephthalate having an intrinsic viscosity [$\eta$] of 0.634 dl/g as measured at 35° C. in a 2/1 mixed solvent of phenol/tetrochloroethane was melt-extruded into filaments by using an apparatus similar to that shown in FIG. 1, which apparatus provided with a spinneret having 36 circular orifices 0.35 mm in diameter. The spinning temperature was 298° C. The other spinning conditions are shown in Table 1. The as-spun fiber yarn was cooled and solidified, and an oiling agent was applied to the yarn and the yarn was wound at a speed of 3,800 m/min.

The denier of the wound yarn and the temperature of cooling air supplied in parallel to the running direction of the yarn were as shown in Table 1. The internal structure and properties of the obtained wound yarn are shown in Table 1.

Six kinds of the wound yarns shown in Table 1 were subjected to the false twisting treatment under conditions shown in Table 2. The false twisting properties and the properties of the obtained false-twisted yarns shown in Table 2.

TABLE 1

| Symbols of Wound Yarn | A | B | C | D | E | F |
|---|---|---|---|---|---|---|
| Size (denier, d) of Wound Yarn | 75 | 50 | 100 | 150 | 75 | 75 |
| Extrusion Rate (g/min) | 31.7 | 21.1 | 42.2 | 63.3 | 31.7 | 31.7 |
| Cooling Air Temperature (°C.) | 15 | 15 | 15 | 15 | 30 | 5 |
| Mean Birefringence Index ($\times 10^{-3}$) | 57 | 85 | 45 | 41 | 52 | 61 |
| $n_{//(0)}$ | 1.650 | 1.666 | 1.621 | 1.603 | 1.641 | 1.657 |
| $n_{//(0.8)} - n_{//(0)}$ ($\times 10^{-3}$) | 5.0 | 6.6 | 4.1 | 3.7 | 4.4 | 5.3 |
| Shrinkage (%) in Boiling Water | 15.0 | 7.3 | 18.4 | 20.3 | 17.2 | 12.8 |

TABLE 2

Figure 13:
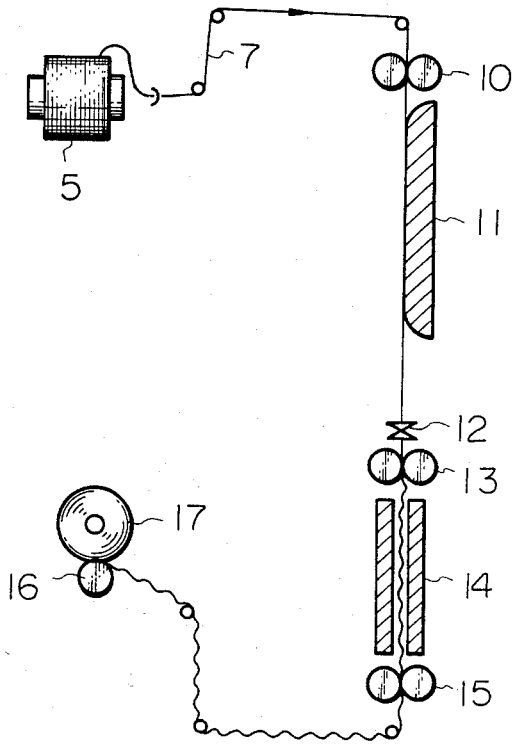
FIG. 13 is a diagram illustrating an example of the conventional apparatus for carrying out the false twisting treatment or draw-false twisting treatment.

| | Present Invention | | Comparison | | | Present Invention | | Comparison | | | | |
|---|---|---|---|---|---|---|---|---|---|---|---|---|
| Treatment Symbol | (A) | (B) | (C) | (D) | (E) | (F) | (G) | (H) | (I) | (J) | (K) | (L) |
| Feed Yarn | A | B | C | D | E | F | A | B | C | D | E | F |
| Type of Method | Method shown in FIG. 4 | | | | | | Method shown in FIG. 13 | | | | | |
| (13)/(10) | 1.308 | 1.125 | 1.475 | 1.537 | 1.386 | 1.296 | 1.308 | 1.125 | 1.475 | 1.537 | 1.386 | 1.296 |
| Calculated Denier (d) after Drawing | 57.3 | 44.4 | 67.8 | 97.6 | 54.1 | 57.9 | 57.3 | 44.4 | 67.8 | 97.6 | 54.1 | 57.9 |
| Twist Number (t/m) | 3810 | 4244 | 3552 | 3064 | 3903 | 3794 | 3810 | 4244 | 3552 | 3064 | 3903 | 3794 |
| Yarn Speed (m/min) (surface speed of Roller (13)) | 137 | 123 | 138 | 154 | 133 | 137 | 137 | 123 | 138 | 154 | 133 | 137 |
| Spindle Head Rotation Number (rpm) | 520,500 | 520,500 | 490,000 | 472,000 | 520,500 | 520,500 | 520,500 | 520,500 | 490,000 | 472,000 | 520,500 | 520,500 |
| Surface Speed (m/min) of Roller (10) | 105 | 109 | 94 | 100 | 96 | 106 | 105 | 109 | 94 | 100 | 96 | 106 |
| Heat Treatment | Effected | | | | | | Not effected | | | | | |
| Yarn Breakage (times/216 spindles × one hour) | 0.23 | 0.25 | 3.06 | 3.82 | 2.48 | 0.24 | 0.83 | 1.24 | 0.78 | 0.69 | 0.81 | 0.94 |
| Fluff Formation (fluffs/kg) | 1.52 | 1.73 | 9.43 | 7.58 | 11.4 | 1.43 | 18.3 | Great many | 8.92 | 6.43 | Great many | 12.4 |
| Crimp Retention (%) | 71.8 | 74.7 | 58.9 | 55.6 | 60.7 | 73.3 | 60.2 | 63.4 | 55.7 | 52.3 | 58.3 | 61.4 |

In Example 1, in case of the production of the crimped polyester yarn of the present invention, the false twisting treatment was carried out according to the method shown in FIG. 4, and in case of the comparative conventional technique, the false twisting treatment or draw-false twisting treatment was carried out according to the method shown in FIG. 13.

The false twisting conditions other than those shown in Table 2 were as follows.

In the heat treatment zone shown in FIG. 4, a tube heater of the non-contact type was used as the heat-treating heater, and the tube heater diameter was 8 mm, the tube heater length was 1.3 m, the surface temperature of the tube heater was 250° C. and the fiber feed ratio at the heat treatment $100\times[(R_0-R_1)/R_0]$ was 0%. In the false twisting zone commonly used in the methods shown in FIGS. 4 and 13, in both the present invention and the comparison, the false twisting treatment were carried out under the same conditions. More specifically, the false twisting heater length was 1.0 m, the false twisting heater temperature was 200° C., the stabilizing heater length was 0.6 m, the stabilizing heater diameter was 4 mm, the stabilizing heater temperature was 190° C., the fiber feed ratio at the stabilizing heater $100\times[(R_2-R_3)/R_2]$ was +16% and the winding rate was −8.7%.

From the results shown in Table 2, it is seen that in the conventional false twisting method, if the fiber denier was as fine as 1.2 to 2.7 d, formation of fluffs could not be avoided, but if the process of the present invention was adopted, the number of fluffs was drastically reduced. It also is seen that even if the process of the present invention was adopted, when the internal structure of the constituent filaments of the feed yarn was not highly oriented or crystallized to some extent on the average as specified in the present invention or the two-layer structure was not sufficiently developed, the operation adaptability to the false twisting treatment was very bad and the practical operation on an industrial scale was very difficult.

Accordingly, it was confirmed that if the process of the present invention is adopted, formation of fluffs and occurrence of yarn breakages are remarkably reduced, the crimp retention of the obtained yarn is highly improved and degradation of the feel and touch of the yarn or a fabric thereof occurs only to a minimized extent at the subsequent weaving, knitting and dyeing steps.

It was actually determined how the internal structure of the filaments of the feed yarn was converted to the two-layer structure by the heat treatment using the tube heater 9 shown in FIG. 4 in the process of the present invention. More specifically, in each of runs of treatment symbols (A), (B), (C), (D), (E) and (F), the yarn was passed only through the second feed roller ($R_0$) 8, tube heater 9 and first feed roller ($R_1$) 10 in FIG. 4 and the yarn was directly taken up onto the friction roll ($R_4$) 16, and the $[n_{\parallel(0.8)}-n_{\parallel(0)}]$ value of the constituent filaments of the yarn was determined. The obtained results are shown in Table 3.

TABLE 3

| | Treatment Symbol | | | | | |
|---|---|---|---|---|---|---|
| | (A) | (B) | (C) | (D) | (E) | (F) |
| $[n_{//(0.8)} - n_{//(0)}] \times 10^{-3}$ | 5.4 | 7.3 | 4.0 | 3.6 | 4.4 | 5.8 |

From the results shown in Table 3, it will readily be understood that if a filament having the two-layer structure specified in the present invention is subjected to the heat treatment of the present invention, the two-layer structure becomes more prominent, while in case of a filament having a structure outside the scope of the present invention, even if the heat treatment is similarly conducted, formation of the intended two-layer structure is advanced only to a minor extent or rather inhibited.

EXAMPLE 2

The wound yarn A used in Example 1 was supplied and treated according to the process of the present invention and the comparative method by using the apparatus shown in FIG. 4. Furthermore, a drawn polyester yarn (75 d/36 f, $\Delta n = 166$) as a comparison was similarly treated.

The treatment conditions are as shown in Table 4. In Table 4, the heat treatment time was calculated from the length of the heat-treating heater and the position of the first feed rollers (10).

TABLE 4

| | Comparison | Present Invention | | | | Comparison | | | Present Invention | | | | Comparison | |
|---|---|---|---|---|---|---|---|---|---|---|---|---|---|---|
| Treatment Symbol | A-1 | A-2 | A-3 | (A) | A-4 | A-5 | A-6 | A-7 | (A) | A-8 | A-9 | A-10 | A-11 | Z |
| Temperature (°C.) of Heat-Treating Heater | 210 | 220 | 235 | 250 | 290 | 300 | 250 | 250 | 250 | 250 | 250 | 250 | 250 | 250 |
| Fiber Feed Rate (%) at Heat Treatment | 0 | 0 | 0 | 0 | 0 | 0 | +30 | +20 | 0 | −20 | −40 | −70 | −80 | 0 |
| Draw-False Twisting (13)/(10) | 1.308 | 1.308 | 1.308 | 1.308 | 1.308 | 1.308 | 1.764 | 1.572 | 1.308 | 1.183 | 1.062 | 0.960 | 0.942 | 1.030 |
| Calculated Denier (d) after Drawing | 57.3 | 57.3 | 57.3 | 57.3 | 57.3 | 57.3 | 60.7 | 59.6 | 57.3 | 52.8 | 50.4 | 46.0 | 44.2 | 72.8 |
| Twist Number (t/m) | 3810 | 3810 | 3810 | 3810 | 3810 | 3810 | 3720 | 3810 | 3810 | 4045 | 4045 | 4045 | 4251 | 3949 |
| Yarn Speed (m/min) (surface speed of Roller (13) | 137 | 137 | 137 | 137 | 137 | 137 | 140 | 137 | 137 | 120 | 120 | 120 | 104 | 102 |
| Rotation Number (rpm) of Spindle Head ($\times 10^3$) | 520.5 | 520.5 | 520.5 | 520.5 | 520.5 | 520.5 | 520.5 | 520.5 | 520.5 | 485 | 485 | 400 | 440 | 400 |
| Surface Speed (m/min) of Roller (10) | 105 | 105 | 105 | 105 | 105 | 105 | 79.4 | 87.2 | 105 | 101 | 113 | 125 | 110 | 99.0 |
| Heat Treatment Time (sec) | 0.74 | 0.74 | 0.74 | 0.74 | 0.74 | 0.74 | 0.98 | 0.89 | 0.74 | 0.77 | 0.69 | 0.62 | 0.71 | 0.77 |
| Yarn Breakage (times/216 spindles × one hour) | 0.63 | 0.57 | 0.25 | 0.23 | 0.24 | 0.94 | 0.98 | 0.42 | 0.23 | 0.20 | 0.31 | 0.45 | 0.68 | 0.21 |
| Fluff Formation (fluffs/kg) | 3.21 | 2.32 | 1.94 | 1.52 | 1.63 | 4.93 | 4.95 | 1.73 | 1.52 | 1.43 | 1.64 | 1.85 | 2.34 | 1.40 |
| Crimp Retention (%) | 63.3 | 67.5 | 70.1 | 71.8 | 73.4 | 74.6 | 74.2 | 73.3 | 71.8 | 70.3 | 68.4 | 66.3 | 64.3 | 75.0 |
| Dye Up-Take Ratio (%) | 80.2 | 84.6 | 87.3 | 90.6 | 91.4 | 91.7 | 94.2 | 93.4 | 90.6 | 88.7 | 85.3 | 84.2 | 76.2 | 42.1 |

The treating conditions other than those shown in Table 4 were the same as the conditions of the run of Treatment Symbol (A) in Example 1.

From the results shown in Table 4, it will readily be understood that if the temperature of the heat-treating heater is adjusted to 220° to 290° C. and the fiber feed ratio at the heat treatment is controlled within the range of from +20% to −70%, good results can be obtained with respect to the dyeability under normal pressure and the adaptability to the false twisting treatment. It will also be found that even if a customarily used drawn polyester yarn is subjected to the heat treatment, no dyeability under normal pressure can be obtained.

EXAMPLE 3

A wound yarn G was prepared in the same manner as adopted for obtaining the wound yarn A in Example 1 except that in the spinning and winding apparatus shown in FIG. 1, the fluid sucking device 4 was not disposed and cooling air maintained at 5° C. was blown against the running spun yarn only in the direction perpendicular to the running direction of the spun yarn. The internal structure and properties of the wound yarn are shown in Table 5.

TABLE 5

| Symbol of Wound Yarn | A | G |
|---|---|---|
| Wound Yarn Denier (d) | 75 | 75 |
| Temperature (°C.) of Cooling Air of Fluid Sucking Device | 15 | Not used |
| Temperature (°C.) of Cooling Air in Direction Perpendicular to Running Direction of Spun Yarn | Not measured | 5 |
| Mean Birefringence Index ($\times 10^{-3}$) | 57 | 59 |
| $n_{//(0)}$ | 1.650 | 1.640 |
| $n_{//(0.8)}$ | 1.655 | 1.685 |
| $n_{//(-0.8)}$ | 1.655 | 1.623 |
| Minimum Value of $n_{//}$ | 1.650 | 1.620 |
| Distribution of Internal Structure | Symmetric | Asymmetric |
| Tight Spots | Not formed | Formed under certain processing conditions |

When the wound yarns A and G were subjected to the treatment of the present invention under the same conditions as adopted in the run of Treatment (A) in Example 1, as is seen from Table 5, the wound yarn in which the internal structure distribution was symmetric was superior to the wound yarn in which the internal structure distribution was asymmetric, because no untwisting irregularities were formed.

EXAMPLE 4

Figure 14:
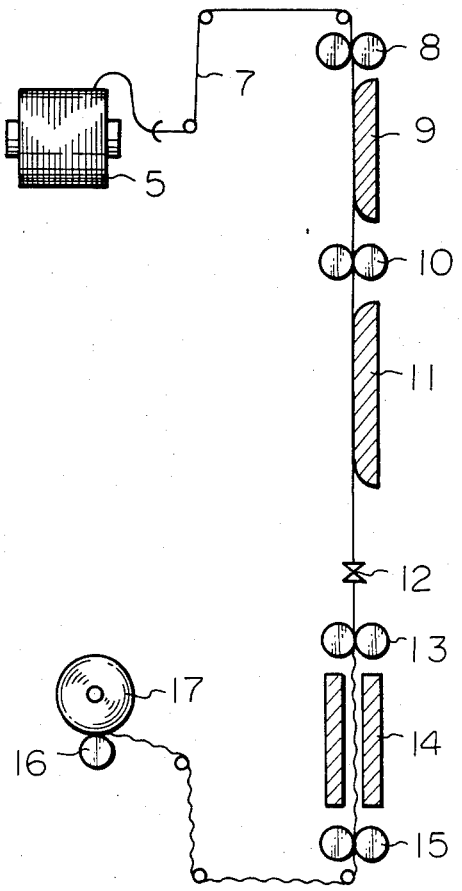
FIG. 14 is a diagram illustrating an embodiment of the process of the present invention in which the yarn is heat-treated by a neat-treating heater of the non-contact type.

The wound yarn A shown in Table 1 was supplied and the treatment of the present invention was carried out by using the apparatuses shown in FIGS. 4 and 14. The heat treatment conditions in the heat treatment zone are shown in Table 4, and other processing conditions were the same as in the run of Treatment (A) in Example 1.

The obtained results are shown in Table 6.

TABLE 6

| Treatment Symbol | (A) | (M) | (N) | (O) | (W) |
|---|---|---|---|---|---|
| Treating Method | Method of FIG. 4 | Method of FIG. 4 | Method of FIG. 4 | Method of FIG. 4 | Method of FIG. 4 |
| Heat Treatment Method | Non-contact | Non-contact | Non-contact | Contact | Non-contact heating and subsequent application of oiling agent |
| Heat-Treating Heater | Hollow tube heater | Hollow Tube heater | Hollow tube heater | Hot plate heater | Hollow tube heater |
| Length (m) of Heat-Treating Heater | 1.30 | 1.05 | 0.80 | 1.30 | 1.30 |
| Heat Treatment Time (sec) | 0.74 | 0.60 | 0.46 | 0.74 | 0.74 |
| Threading Property | A | A | A | A-B | A |
| Yarn Breakage (times/216 spindles/one hour) | 0.23 | 0.23 | 0.24 | 0.95 | 0.05 |
| Fluff Formation (fluffs/kg) | 1.52 | 1.64 | 1.83 | 4.87 | 0.03 |
| Crimp Retention (%) | 71.8 | 70.2 | 69.4 | 74.5 | 72.3 |
| Dye Up-Take Ratio (%) | 90.6 | 86.2 | 83.3 | 92.3 | 90.2 |

From the results shown in Table 6, it will readily be understood that in view of the false twisting properties such as the threading property, yarn breakage and fluff formation, it is preferred that the heat treatment be carried out by using a heat-treating heater of the non-contact type.

Furthermore, it will be understood that if a heat-treatment heater of the non-contact type is used and an oiling agent is applied after the heat treatment, best results are obtained with respect to the false twisting properties such as the yarn hanging property, yarn breakage and fluff formation.

EXAMPLE 5

The wound yarn A shown in Table 1 was fed to the apparatus shown in FIG. 4 and the process of the present invention was carried out while varying the temperature of the heat-treating heater, the fiber feed ratio at the heat treatment and the temperature of the false twisting heater as indicated in Table 7, though other treating conditions remained the same as in the run of Treatment (A) in Example 1.

From the results shown in Table 7, it will readily be understood that (1) a fiber feed ratio at the heat treatment of substantially 0% to 15% (in this case, the shrinkage in boiling water is the same as that of the yarn A) is preferred because good dyeability under normal pressure and good adaptability to the false twisting treatment can be obtained in combination, (2) in order to improve the dyeability under normal pressure, it is preferred that the temperature of the heat-treating heater be adjusted to at least 200° C. and (3) it is preferred that the false twisting treatment be carried out by adjusting the temperature of the false twisting heater to a level lower than the heat treatment temperature, because the dyeability under normal pressure is further improved.

It will also be understood that in order to obtain a good dyeability under normal pressure, a customarily used false twisting heater of the contact type is preferable to a false twisting heater of the non-contact type.

TABLE 7

| Treatment Symbol | (A) | (P) | (Q) | (R) | (S) | (T) | (U) | (V) | (X) |
|---|---|---|---|---|---|---|---|---|---|
| Temperature (°C.) of Heat-Treating Tube Heater | 250 | 250 | 250 | 185 | 265 | 250 | 250 | 250 | 250 |
| Fiber Feed Ratio (%) at Heat Treatment | 0 | 0 | 0 | 0 | 0 | +15 | +20 | −15 | 0 |
| Surface Speed (m/min) of Roller (10) | 105 | 105 | 105 | 105 | 105 | 91 | 87 | 124 | 105 |
| Heat Treatment Time (sec) | 0.74 | 0.74 | 0.74 | 0.74 | 0.74 | 0.85 | 0.89 | 0.63 | 0.74 |
| (13)/(10) | 1.308 | 1.308 | 1.308 | 1.308 | 1.308 | 1.501 | 1.572 | 1.102 | 1.308 |
| Calculated Denier (d) after Drawing | 57.3 | 57.3 | 57.3 | 57.3 | 57.3 | 58.8 | 59.6 | 59.2 | 57.3 |
| Temperature (°C.) of False Twisting Heater | 200 | 190 | 210 | 200 | 200 | 200 | 200 | 200 | 200° C. by false twisting heater of non-contact type |
| Threading Property | A | A | A | A | A | A | A | A | A |
| Yarn Breakage (times/216 spindles × one hour) | 0.23 | 0.19 | 0.25 | 0.25 | 0.22 | 0.19 | 0.84 | 0.26 | 0.21 |
| Fluff Formation (fluffs/kg) | 1.52 | 1.31 | 1.73 | 1.67 | 1.43 | 1.35 | 4.73 | 1.41 | 1.43 |
| Crimp Retention (%) | 71.8 | 69.4 | 73.3 | 64.5 | 72.5 | 72.1 | 73.3 | 71.3 | 66.3 |
| Dye Up-Take Ratio (%) | 90.6 | 91.4 | 74.3 | 68.7 | 92.7 | 93.1 | 93.4 | 70.2 | 72.3 |

EXAMPLE 6

Polyethylene terephthalate having an intrinsic viscosity [η] of 0.63 dl/g as measured at 35° C. in a 2/1 mixed solvent of phenol/tetrachloroethane was melt-extruded through a spinneret having 36 holes 0.35 mm in diameter at a spinning temperature of 300° C., and the spun yarn was cooled to be solidified by an air current maintained at 22° C. and supplied in the direction parallel to the running direction of the yarn. An oiling agent was applied to the yarn and the yarn was wound at a speed of 2,000 to 6,000 m/min. The so-obtained 75 d/36 f polyester yarn having properties shown in Table 8 was treated by using an apparatus shown in Table 9 under conditions shown in Table 10. The obtained results are shown in Table 11.

TABLE 8

| Symbol of Feed Yarn | A | C | D | E |
|---|---|---|---|---|
| Extrusion Rate (g/min) | 16.7 | 33.3 | 41.7 | 50.0 |
| Winding Speed (km/min) | 2 | 4 | 5 | 6 |
| Mean Birefringence Index ($\times 10^{-3}$) | 13 | 58 | 86 | 118 |
| Shrinkage (%) in Boiling Water | 57.9 | 15.7 | 13.0 | 3.7 |

TABLE 9

| Treatment Method | FIG. 4 | FIG. 13 |
|---|---|---|
| Tube Heater Diameter (mm) | 8 | Tube heater was not used |
| Tube Heater Length (m) | 1.3 | |
| Temperature (°C.) of Heat-Treating Tube Heater | 250 | |
| Fiber Feed Ratio (%) at Heat Treatment $\left(\frac{(8)-(10)}{(8)} \times 100\right)$ | 0 | Heat treatment was not effected |
| False Twisting Heater Length (m) | 1 | 1 |
| Temperature (°C.) of False Twisting Heater | 200 | 200 |
| Stabilizing Heater Diameter (mm) | 4 | 4 |
| Stabilizing Heater Length (m) | 0.6 | 0.6 |
| Temperature (°C.) of Stabilizing Heater | 190 | 190 |
| Fiber Feed Ratio (%) at Stabilizing Heater $\left(\frac{(13)-(15)}{(13)} \times 100\right)$ | +16 | +16 |

TABLE 10

| | Comparison | Present Invention | | | Comparison | | | |
|---|---|---|---|---|---|---|---|---|
| Treatment Symbol | F | H | I | J | K | M | N | O |
| Feed Yarn | (A) | (C) | (D) | (E) | (A) | (C) | (D) | (E) |
| Treating Method | | FIG. 4 | | | | FIG. 13 | | |
| (13)/(10) | 2.152 | 1.308 | 1.125 | 1.045 | 2.152 | 1.308 | 1.125 | 1.045 |
| Calculated Denier (d) after Drawing | 34.9 | 57.3 | 66.7 | 71.8 | 34.9 | 57.3 | 66.7 | 71.8 |
| Twist Number (t/m) | 4707 | 3810 | 3577 | 3470 | 4707 | 3810 | 3577 | 3470 |
| Yarn Speed (m/min) (surface speed of Roller (13) | 137 | 137 | 146 | 150 | 137 | 137 | 146 | 150 |
| Winding Ratio (%) $\left(\frac{(15)-(16)}{(15)} \times 100\right)$ | −8.7 | −8.7 | −8.7 | −8.7 | −8.7 | −8.7 | −8.7 | −8.7 |
| Rotation Number (rpm) of Spindle Head | 643,500 | 520,500 | 520,500 | 520,500 | 643,500 | 520,500 | 520,500 | 520,500 |
| Surface Speed (m/min) of Roller (10) | 63.7 | 104.7 | 129.8 | 143.5 | 63.7 | 104.7 | 129.8 | 143.5 |
| Heat Treatment Time (sec) | 1.22 | 0.74 | 0.60 | 0.54 | Heat treatment was not effected | | | |

TABLE 11

| | Comparison | Present Invention | | | Comparison | | | |
|---|---|---|---|---|---|---|---|---|
| Treatment Symbol | F | H | I | J | K | M | N | O |
| Threading Property | C | A | A | A | A | A | A | A |
| Yarn Breakage (times/216 spindles × one hour) | 8.34 | 0.21 | 0.14 | 0.23 | 1.24 | 0.88 | 0.97 | 0.86 |
| Fluff Formation (fluffs/kg) | Many | 1.54 | 1.23 | 0.71 | Many | 18.38 | 14.27 | 11.65 |
| Crimp Retention (%) | — | 72 | 76 | 79 | 50 | 58 | 61 | 63 |
| Dye Up-Take Ratio (%) | — | 91 | 86 | 83 | Not measured | | | |

From the results shown in Table 11, it is seen that in the conventional false twisting method, if the single filament denier is as fine as 75/36, formation of fluffs cannot be avoided, but if the process of the present invention is adopted, formation of fluffs is drastically reduced.

Furthermore, it is seen that if the process of the present invention is adopted, formation of fluffs is remarkably reduced and the crimp retention of the obtained yarn is drastically improved, and degradation of the feel and touch is not caused at the subsequent weaving, knitting, dyeing and other finishing steps. Moreover, as is seen from Table 10, in the process of the present invention, if the yarn is passed through the tube heater for at least 0.4 second, the obtained processed yarn is highly improved in the dyeability under normal pressure.

EXAMPLE 7

Polyethylene terephthalate having an intrinsic viscosity [η] of 0.68 dl/g as measured at 35° C. in a 2/1 mixed solvent of phenol/tetrachloroethane was spun under conditions shown in Table 12 by using the spinning and winding apparatus shown in FIG. 1 to obtain a polyester yarn shown in Table 12.

Incidentally, in the present and subsequent Examples, the tenacity was measured according to the method of JIS L-1069 (the tensile test method for fibers).

TABLE 12

| Symbol of Yarn | A | B | C |
|---|---|---|---|
| Extrusion Rate (g/min) | 79.0 | 86.0 | 103.3 |
| Spinning Speed V (km/min) | 3.0 | 4.5 | 6.0 |
| Denier/Filament | 237/48 | 172/48 | 155/48 |
| Mean Birefringence Index Δn ($\times 10^{-3}$) | 20 | 69 | 105 |

Figure 9:
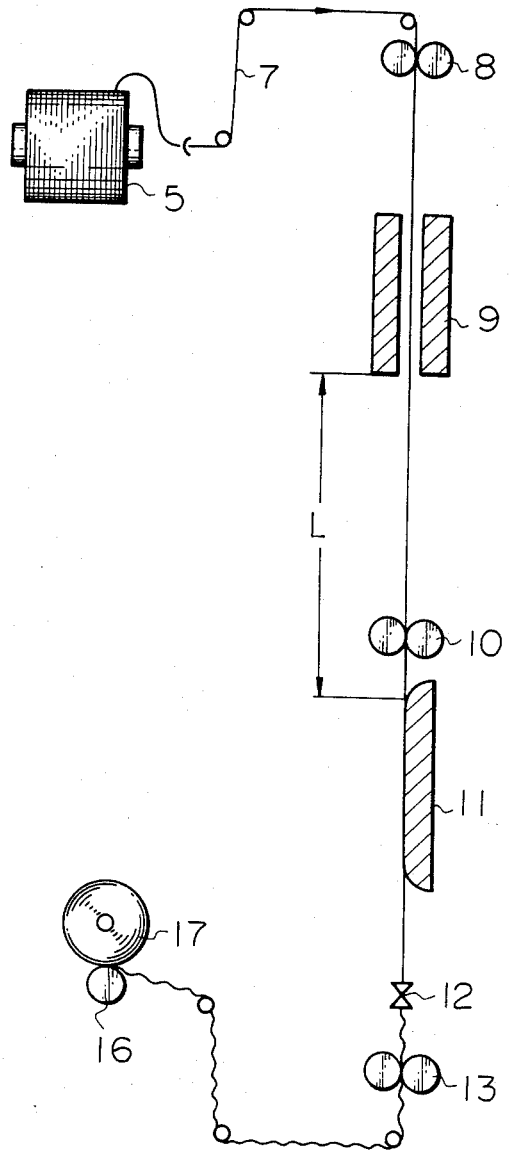
FIG. 9 is a diagram showing another embodiment of the process of the present invention, in which the yarn is heat-treated by a heat-treating heater of the non-contact type and the heat-treated yarn is sufficiently cooled in a room temperature atmosphere during the passage of from the heat-treating heater to the false twisting heater.

The yarns A, B and C shown in Table 12 were treated by using the apparatus shown in FIG. 9 and Table 13 under conditions shown in Table 14. The treating temperature was room temperature, 20° C.

The obtained results are shown in Table 15.

TABLE 13

| | |
|---|---|
| Yarn Path | As shown in FIG. 9 |
| Slit Heat Position | Variable (L is variable) |
| Slit Heater Length (m) | 1.1 |
| Slit Heater Temperature (°C.) | 260 |
| False Twisting Heater Length (m) | 1.0 |
| False Twisting Heater Temperature (°C.) | 200 |
| Winding Ratio (%) $\left(\frac{(13)-(16)}{(13)} \times 100\right)$ | +4% |
| Spindle Head Rotation Number (rpm) | 375,000 |
| Twist Number (t/m) | 2,500 |
| Yarn Speed (m/min) (surface speed of Roller (13) | 150 |

TABLE 14

| Yarn | A | B | C |
|---|---|---|---|
| Draw Ratio [(10)/(8)] at Heat Treatment | 1.400 | 1.000 | 0.980 |
| Tension (g/d) at Heat Treatment | 0.15 | 0.05 | 0.03 |
| Cooling Length L (m) | Varied as shown in Table 15 | | |
| Draw Ratio [(13)/(10) at Draw-False Twisting | 1.130 | 1.150 | 1.050 |

In Table 14, the tension at the heat treatment was obtained by dividing the tension at the outlet of the slit heater 9 in FIG. 9 by the denier of the yarn after the heat treatment.

TABLE 15

| Yarn | L (m) | 0.1 | 0.16 | 0.2 | 0.4 | 0.8 | 1.1 | 1.6 | 2.5 | 3.0 |
|---|---|---|---|---|---|---|---|---|---|---|
| | Cooling Time (sec) | 0.04 | 0.064 | 0.08 | 0.16 | 0.32 | 0.44 | 0.64 | 1.00 | 1.20 |
| A | Dye Up-Take Ratio (%) | — | — | — | — | 81.1 | 81.6 | 82.3 | 83.5 | 84.2 |
| | Tenacity (g/d) | — | — | — | — | 3.23 | 3.20 | 3.18 | 3.15 | 3.13 |
| B | Dye Up-Take Ratio (%) | — | — | — | 81.9 | 82.6 | 83.1 | 83.9 | — | — |
| | Tenacity (g/d) | — | — | — | 3.25 | 3.24 | 3.23 | 3.21 | — | — |
| C | Dye Up-Take Ratio (%) | 82.7 | 83.2 | 83.2 | 83.4 | 83.7 | — | — | — | — |
| | Tenacity (g/d) | 3.33 | 3.32 | 3.32 | 3.32 | 3.31 | — | — | — | — |

In case of V=3.0 (yarn A), the critical cooling time A is 1.0 second, in case of V=4.5 (yarn B), the critical cooling time A is 0.48 second, and in case of V=6.0 (yarn C), the critical cooling time A is 0.063 second.

From Table 15, it is seen that when a polyester yarn is heat-treated and subsequently subjected to the false twisting treatment to obtain an easily dyeable false-twisted yarn, if natural cooling is carried out after the heat treatment for a time of $$A\left(=\frac{7-V}{4(V-2.0)}\text{ second}\right)$$

or longer, there can always be obtained a false-twisted yarn having a practically sufficient tenacity and a good dyeability.

EXAMPLE 8

In the same manner as in Example 7, the yarn B of Example 7 was treated under conditions shown in Tables 13 and 14 by using the apparatus shown in FIG. 9. Incidentally, the cooling length L was 1.6 m, the cooling time A was 0.64 second and the cooling conditions were as shown in Table 16.

TABLE 16

| | Run No. 2-(1) | Run No. 2-(2) |
|---|---|---|
| Cooling Conditions | Natural cooling in room temperature (20° C.) atmosphere | Hot air maintained at 210° C. was blown against yarn 7 uniformly throughout cooling length L (heating) |

The obtained results are shown in Table 17.

TABLE 17

| | Run No. 2-(1) | Run No. 2-(2) |
|---|---|---|
| Dye Up-Take Ratio (%) of Textured Yarn | 83.9 | 58.2 |
| Tenacity (g/d) of Textured Yarn | 3.21 | 3.08 |

From the results shown in Table 17, it is seen that when a polyester yarn is heat-treated and subsequently subjected to the false twisting treatment or draw-false twisting treatment, if the yarn is once cooled after the heat treatment, there can be obtained a false-twisted yarn having a practically sufficient strength and a good dyeability.

EXAMPLE 9

In the same manner as in Example 7, the yarn B of Example 7 was treated under conditions shown in Tables 13 and 14 by using the apparatus shown in FIG. 9. The cooling conditions adopted were as shown in Table 18.

The obtained results are shown in Table 19.

TABLE 18

| | Run No. | | | |
|---|---|---|---|---|
| | 3-(1) | 3-(2) | 3-(3) | 3-(4) |
| Cooling Conditions | Cold air maintained at 7° C. was blown against yarn uniformly throughout cooling length L | | Natural cooling in room temperature (20° C.) atmosphere | |
| Cooling Length (m) | 0.4 | 1.1 | 0.4 | 1.1 |
| Cooling Time (sec) | 0.16 | 0.44 | 0.16 | 0.44 |

TABLE 19

| | Run No. | | | |
|---|---|---|---|---|
| | 3-(1) | 3-(2) | 3-(3) | 3-(4) |
| Dye Up-Take Ratio (%) of Textured Yarn | 83.6 | 85.7 | 81.9 | 83.1 |
| Tenacity (g/d) of Textured Yarn | 3.22 | 3.20 | 3.25 | 3.23 |

From the results shown in Table 19, it is seen that a higher cooling effect is attained by forced cooling than by natural cooling and in case of forced cooling, therefore, the cooling length and cooling time can be shortened.

EXAMPLE 10

Polyethylene terephthalate having an intrinsic viscosity [η] of 0.64 dl/g as measured at 35° C. in a 2/1 mixed solvent of phenol/tetrachloroethane was melt-extruded from a spinneret having 32 holes 0.35 mm in diameter at a spinning temperature of 298° C., and the spun yarn was cooled to be solidified by an air current maintained at 25° C. and supplied in the direction parallel to the running direction of the yarn. Then, an oiling agent was applied to the yarn and the yarn was wound at a speed of 3,000 to 9,000 m/min. The obtained 150 d/32 f polyester yarn having properties shown in Table 20 was treated by using an apparatus shown in Table 21 under conditions shown in Table 22. The obtained results are shown in Table 23. During the false twisting treatment, twists given to the yarn were propagated upstream to the heat-treating heater, and the twists shown in Table 22 were given to the yarn at the heat treatment.

TABLE 20

| | As-Spun Yarn | | | | | |
|---|---|---|---|---|---|---|
| | A | B | C | D | E | F |
| Winding Speed (km/min) | 2 | 4 | 5 | 6 | 7 | 9 |
| Extrusion Rate (g/min) | 87.6 | 87.6 | 94.4 | 105 | 120 | 150 |
| Apparent Denier (d) | 394 | 197 | 170 | 158 | 155 | 150 |
| Mean Birefringence Index ($\times 10^{-3}$) | 12 | 52 | 83 | 102 | 111 | 79 |

TABLE 21

| | Treating Method | |
|---|---|---|
| Type of apparatus | FIG. 4 (I) | FIG. 4 (II) |
| Heat-Treating Heater Length (m) | 1 | Heat-treating heater was not used |
| Heat-Treating Heater Temperature (°C.) | 250 | |
| False Twisting Heater Temperature (°C.) | 200 | 200 |
| Winding Ratio (%) $\left(\frac{(13)-(16)}{(13)} \times 100\right)$ | +4 | +4 |
| False Twisting Heater Length (m) | 1 | 1 |
| Twist Numbers (t/m) | 2500 | 2500 |

TABLE 22

| | Comparison | Present Invention | | | | | | | Comparison | | |
|---|---|---|---|---|---|---|---|---|---|---|---|
| Run No. | 1 | 2 | 3 | 4 | 5 | 6 | 7 | 8 | 9 | 10 | 11 |
| As-Spun Yarn | A | B | C | D | E | F | B | C | D | E | F |
| Treating Method | (I) | (I) | (I) | (I) | (I) | (I) | (II) | (II) | (II) | (II) | (II) |
| Rotation Number (rpm) of Spindle Head ($\times 10^4$) | 25 | 25 | 25 | 25 | 25 | 25 | 25 | 25 | 25 | 25 | 25 |
| Surface Speed (m/min) of Delivery Roller | 100 | 100 | 100 | 100 | 100 | 100 | 100 | 100 | 100 | 100 | 100 |
| Surface Speed (m/min) of Feed Roller | 61.2 | 7.62 | 88.3 | 95.0 | 96.8 | 100.0 | 76.2 | 88.3 | 95.0 | 96.8 | 100.0 |
| Draw Ratio [(13)/(10)] | 1.633 | 1.313 | 1.133 | 1.053 | 1.033 | 1.000 | 1.313 | 1.133 | 1.053 | 1.033 | 1.000 |
| Heat Treatment Time (sec) | 0.98 | 0.79 | 0.68 | 0.63 | 0.62 | 0.60 | Heat treatment was not effected | | | | |
| Twist Number (t/m) on Heat-Treating Heater | 79 | 83 | 85 | 87 | 89 | 92 | — | | | | |

TABLE 23

| | Comparison | Present Invention | | | | | | Comparison | | | |
|---|---|---|---|---|---|---|---|---|---|---|---|
| Run No. | 1 | 2 | 3 | 4 | 5 | 6 | 7 | 8 | 9 | 10 | 11 |
| Threading Property | C | A | A | A | A | A | A | A | A | A | A |
| Dye Up-Take Ratio (%) | Treading Operation Impossible | 91 | 87 | 83 | 83 | 83 | 58 | 63 | 67 | 70 | 77 |

From the results shown in Table 23, it is seen that according to the process of the present invention, a textured polyester yarn having a highly improved dyeability can be obtained while according to the conventional draw-false twisting process, a textured polyester yarn having a good dyeability cannot be obtained. It also is seen that when the process of the present invention is adopted, in case of a feed yarn spun at a spinning speed of at least 4,000 m/sec, the yarn hanging property is highly improved.

EXAMPLE 11

The as-spun yarn B used in Example 10 was subjected to the draw-false twisting treatment under the conditions of Run No. 4 of Example 10, while the temperature of the heat-treating heater was varied as shown in Table 24. The obtained results are shown in Table 25.

TABLE 24

| | Run No. | | |
|---|---|---|---|
| | 4-1 | 4 | 4-2 |
| Temperature (°C.) of Heat-Treating Heater | 190 | 250 | 270 |
| Yarn Temperature (°C.) at | 158 | 200 | 217 |

TABLE 24-continued

| | Run No. | | |
|---|---|---|---|
| | 4-1 | 4 | 4-2 |
| Outlet of Heat-Treating Heater | | | |

TABLE 25

| | Comparison | Present Invention | |
|---|---|---|---|
| Run No. | 4-1 | 4 | 4-2 |
| Threading Property | A | A | A |
| Dye Up-Take Ratio (%) | 73 | 91 | 94 |

From the results shown in Table 25, it is seen that if the heat treatment is carried out at such a low temperature as a yarn temperature lower than 190° C., a textured yarn having an improved dyeability cannot be obtained.

EXAMPLE 12

The as-spun yarn B used in Example 10 was subjected to the draw-false twisting treatment according to the process shown in FIG. 7 under conditions shown in Table 26. The obtained results are shown in Table 27.

The heat-treating heater 9 shown in FIG. 7 is a heater of the contact heating type having a length of 0.5 m. The apparatus shown in FIG. 7 is the same as the apparatus shown in FIG. 8 except the heat-treating heater.

TABLE 26

| | Present Invention | Comparison | Present Invention | | |
|---|---|---|---|---|---|
| Run No. | 4 | 12-1 | 12-2 | 12-3 | 12-4 |
| Treating Method | FIG. 8 | FIG. 7 | FIG. 7 | FIG. 7 | FIG. 7 |
| Heat-Treating Heater Length (m) | 1.00 | 0.51 | 0.51 | 0.51 | 0.51 |
| Heat-Treating Heater Temperature (°C.) | 250 | 180 | 195 | 195 | 195 |
| Twist Number (t/m) at Heat-Treating Heater | Not measured | 121 | 75 | 121 | 121 |
| Heat Treatment Time (sec) | 0.79 | 0.40 | | 0.20 | 0.40 |
| Rotation Number (rpm) of Spindle Head | $25 \times 10^4$ | $25 \times 10^4$ | | 492,500 | $25 \times 10^4$ |
| Surface Speed (m/sec) of Delivery Roller | 100 | 100 | | 197 | 100 |
| Surface Speed (m/sec) of Feed Roller | 76.2 | 76.2 | | 150 | 76.2 |

False Twisting Heater Temperature = 200° C.;
False Twisting Heater Length = 1 m;
Twist Number = 2,500 twists/m;
Draw Ratio = 1.313;
Winding Ratio = +4%

TABLE 27

| | Present Invention | Comparison | Present Invention | | |
|---|---|---|---|---|---|
| Run No. | 4 | 12-1 | 12-2 | 12-2 | 12-3 |
| Threading Property | A | A | A | A | A |
| Dye Up-Take Ratio (%) | 91 | 80 | 86 | 83 | 83 |

From the results of Run Nos. 4, 12-2, 12-3 and 12-4 shown in Table 27, it is seen that if the yarn is contacted with the surface of a heat-treating heater maintained at at least 200° C. before the drawing point in the state where at least 3% of final twists are given to the yarn, the threading property is improved and a yarn having an improved dyeability can be obtained by carrying out the heat treatment for a short time. It also is seen that if the heat-treating heater temperature is lower than 200° C., the obtained yarn is not easily dyeable (see Run No. 12-1).

EXAMPLE 13

Polyethylene terephthalate having an intrinsic viscosity [η] of 0.635 dl/g as measured at 35° C. in a 2/1 mixed solvent of phenol/tetrachloroethane was melt-extruded from a spinneret having 36 holes 0.35 mm in diameter at a spinning temperature of 303° C., and the spun yarn was cooled to be solidified by an air current maintained at 20° C. and fed in the direction parallel to the running direction of the yarn. An oiling agent was applied to the yarn and the yarn was wound. Three sets of the extrusion rate and winding speed shown in Table 28 were adopted, and three kinds of 75 d/36 f as-spun yarns X, Y and Z were obtained. These yarns were false-twisted to highly crimped set yarns by using the false twisting apparatus of the present invention shown in Table 29 or the conventional heat-treating heater-provided false twisting apparatus shown in Table 29 under conditions (a), (b), or (c) shown in Table 30. The obtained results are shown in Table 31.

TABLE 28

| Feed As-Spun Yarn | X | Y | Z |
|---|---|---|---|
| Extrusion Rate (g/min) | 50.0 | 33.3 | 41.7 |
| Winding Speed (km/min) | 6 | 4 | 5 |
| Mean Birefringence Index ($\times 10^{-3}$) | 103 | 51 | 85 |

TABLE 29

| False Twisting Apparatus | No. 1 (Present invention) | No. 2 (conventional apparatus) |
|---|---|---|
| Structure | Shown in FIG. 11 | Shown in FIG. 10 |
| Type of Heat-Treating Heater | Non-contact type (hollow pipe) | Contact type |
| Heat-Treating Heater Length (m) | 1.55 | 0.6 |
| False Twisting Heater Length (m) | 0.95 | 0.95 |
| Stabilizing Heater Length (m) | 0.6 | 0.6 |

TABLE 30

| False Twisting Apparatus | No. 1 (present invention) | | | No. 2 (conventional apparatus) | | |
|---|---|---|---|---|---|---|
| Processing Conditions | a | b | c | a | b | c |
| Feed As-Spun Yarn | X | Y | Z | X | Y | Z |
| Rotation Number (rpm) of Spindle Head ($\times 10^4$) | 50 | 50 | 50 | 50 | 50 | 50 |
| Heat-Treating Heater Temperature (°C.) | 250 | 250 | 250 | 200 | 200 | 200 |
| $\frac{R_{-1} - R_0}{R_0} \times 100$ (%) | +2 | 0 | +1 | — | — | — |
| $\frac{R_{-1} - R_1}{R_1} \times 100$ (%) | — | — | — | 0 | 0 | 0 |
| $R_2/R_1$ (draw ratio) | 1.04 | 1.30 | 1.12 | 1.04 | 1.30 | 1.12 |
| False Twisting Heater Temperature (°C.) | 205 | 205 | 205 | 205 | 205 | 205 |
| Twist Number (t/m) | 3,200 | 3,800 | 3,350 | 3,200 | 3,800 | 3,350 |
| Heat-Setting Heater Temperature (°C.) | 185 | 185 | 185 | 185 | 185 | 185 |
| $\frac{R_2 - R_3}{R_2} \times 100$ (%) | +20 | +20 | +20 | +20 | +20 | +20 |

TABLE 30-continued

| | | | | | | |
|---|---|---|---|---|---|---|
| $\frac{R_2 - R_4}{R_2} \times 100$ (%) | +9.5 | +9.5 | +9.5 | +9.5 | +9.5 | +9.5 |

Note (1) $R_0$, $R_{-1}$, $R_1$, $R_2$, $R_3$ and $R_4$ in Table 30 show peripheral speeds (the unit is omitted) of the following members shown in FIGS. 10 and 11.

| | FIG. 41 (Apparatus No. 1) | FIG.10 (Apparatus No. 2) |
|---|---|---|
| $R_{-1}$ | Feed roller 30 | Feed roller r1 |
| $R_0$ | Feed roller 31 | — |
| $R_1$ | Feed roller 32 | Feed roller r2 |
| $R_2$ | Feed roller 33 | Feed roller r3 |
| $R_3$ | Feed roller 34 | Feed roller r4 |
| $R_4$ | Winder 28 | Winder C |

(2) In the apparatus No. 1, the $R_1/R_0$ ratio was adjusted to 1.0.

TABLE 31

| False Twisting Apparatus | No. 1 (present invention) | | | No. 2 (conventional apparatus) | | |
|---|---|---|---|---|---|---|
| Treating Conditions | a | b | c | a | b | c |
| Fluff Formation (fluffs/kg) | 1.02 | 1.53 | 1.20 | 9.87 | Many | Many |
| Yarn Breakage (times/216 spindles × 1 hour) | 0.25 | 0.23 | 0.19 | 1.24 | 5.31 | 3.78 |
| Tight Spots | A | A | A | B | C | B |
| Evenness of Dyeing | Good | Good | Good | Poor | Poor | Poor |
| Yield of Acceptable Dyeing Level (%) | 96 | 90 | 93 | 85 | 78 | 82 |
| Dye Up-Take Ratio (%) | 83 | 93 | 88 | Not measured | | |

Note

The term "many" in the column of the fluff formation indicates "at least 10 fluffs/kg".

From the results shown in Table 31, it is seen that the false twisting apparatus according to the present invention is excellent over the conventional heat-treating heater-provided false twisting apparatus because formation of fluffs and occurrence of yarn breakage are remarkably reduced and good false twisting properties can be obtained, and the false-twisted yarn obtained by using the false twisting apparatus of the present invention is highly improved in the tight spot property, evenness of dyeing, yield of acceptable dyeing level and dyeability.

Example 14

The as-spun yarn Y of Example 13 was subjected to the partially molten-false twisting by using the apparatus No. 1 or No. 2 used in Example 13 to obtain a linen-like partially molten-false-twisted yarn. Treating conditions were as follows.

| | |
|---|---|
| Rotation number of spindle head: | 300,000 rpm |
| $(R_{-1} - R_0)/R_0 \times 100$: | 0% (apparatus No. 1) |
| $R_1/R_0$: | 1.0 (apparatus No. 1) |
| $(R_{-1} - R_1)/R_1 \times 100$: | 0% (apparatus No. 2) |
| $R_2/R_1$ (draw ratio): | 1.26 |
| False twisting heater temperature: | 200° C. |
| Twist number: | 3,350 t/m |
| Stabilizing heater temperature: | 180° C. |
| $(R_2 - R_3)/R_2 \times 100$: | +10% |
| $(R_2 - R_4)/R_2 \times 100$: | +6% |

The above conditions were commonly adopted in both the apparatuses, but the heat-treating temperature was different between the two apparatuses. Namely, this temperature was 265° C. in the apparatus No. 1 and 220° C. in the apparatus No. 2.

The obtained results are shown in Table 32.

TABLE 32

| | Apparatus No. 1 (present invention) | Apparatus No. 2 (conventional apparatus) |
|---|---|---|
| Fluff Formation (fluffs/kg) | 1.78 | Many |
| Yarn Breakage (times/216 spindles × 1 hour) | 0.33 | 9.34 |
| Dye Take-Up Ratio (%) | 85 | 66 |

Note

In case of partially molten-false-twisted yarns, the level dyeing property was not measured or evaluated because of the tight spots and uneven dyeing inherent of partially molten-false-twisted yarns.

From the results shown in Table 32, it is seen that even in case of the partially molten-false twisting treatment, the false twisting apparatus of the present invention is advantageous over the conventional heat-treating heater-provided false twisting apparatus in that formation of fluffs and occurrence of yarn breakage are remarkably reduced, the adaptability to the false twisting treatment is improved and the dye up-take ratio of the obtained yarn is enhanced.

EXAMPLE 15

Polyethylene terephthalate having an intrinsic viscosity of 0.65 dl/g was melt-extruded from a spinneret having 24 orifices, each 0.23 mm in diameter at a spinning temperature of 300° C. The yarn extruded was cooled and solidified with a stream of air at 20° C. supplied in parallel to the direction of the running yarn, and then the yarn was wound at a winding speed of 4,500 m/min. to give multifilaments of 50d/24f by using the spinning apparatus shown in FIG. 1. A mean birefringence index $\Delta n$ of the yarn was $71 \times 10^{-3}$. The wound yarn was subjected to heat treatment for 0.8 second at a feed ratio of 0% by passing through a heat treating heater 9 as shown in FIG. 9, which was placed in an atmosphere of mixed gas containing 80 mol% of super heated steam and 20 mol% of air heated at 235° C. Subsequently the yarn was naturally cooled for 1.2 second in an atmosphere maintained at 25° C., and then the yarn was false-twisted at a fales twisting temperature of 212° C. at a draw ratio of 7% and a twisting number of 3,900 t/m. The tenacity and dye up-take ratio of the fales-twisted yarn are 3.3 g/d and 87%, respectively.

We claim:

1. A process for the producing a false-twisted polyester yarn, which comprises heat-treating a yarn consisting of an as-spun polyester fiber having a mean birefringence index (n) of from $15 \times 10^{-3}$ to $150 \times 10^{-3}$ at a heat-treating heater temperature of 190 to 290° C. for 0.2 to 2.0 seconds, cooling the heat-treated yarn to a temperature lower than the heat treatment temperature, and then continuously subjecting the heat-treated yarn to a false twisting treatment.

2. A process for producing a false-twisted polyester yarn according to claim 1, wherein the as-spun polyester yarn is one which has been spun at a spinning speed of from 2,500 to 10,000 m/min.

3. A process for producing a false-twisted polyester yarn according to claim 2, wherein the mean birefringence index ($\Delta n$) of the as-spun polyester yarn is in the range of from $50\times10^{-3}$.

4. A process for producing a false-twisted polyester yarn according to claim 2, wherein the spinning speed is in the range of from 4,000 to 10,000 m/min.

5. A process for producing a false-twisted polyester yarn according to claim 2, wherein the as-spun polyester fiber consists of filaments having a circular cross-section having a radius R, which satisfy requirements of $n_{\parallel(0)} \geqq 1.650[n_{\parallel(0.8)} - n_{\parallel(0)}] \geqq 5\times10^{-3}$ in which $n_{\parallel(0)}$ stands for the mean refractive index at the center of the cross-section and $n_{\parallel(0.8)}$ stands for the mean refractive index at the portion apart by 0.8 R from the center of the cross-section.

6. A process for producing a false-twisted polyester yarn according to claim 5, wherein the distribution of local mean refractive indexes is substantially symmetric with respect to the center of the filament.

7. A process for producing a false-twisted polyester yarn according to claim 2, wherein the heat treatment is carried out at a fiber feed ratio of from +20% to −70%.

8. A process for producing a false-twisted polyester yarn according to claim 2, wherein the heat treatment is carried out without contacting the as-spun polyester fiber yarn with the surface of a heat-treating heater.

9. A process for producing a false-twisted polyester yarn according to claim 2, wherein the as-spun polyester yarn is one which has been spun at a spinning speed of at least 2,500 m/min but less than 7,000 m/min and the yarn is cooled after the heat treatment and before the false twisting treatment.

10. A process for producing a false-twisted polyester yarn according to claim 2, wherein the as-spun polyester yarn is heat-treated in a twisted state.

11. A process for producing a false-twisted polyester yarn according to claim 10, wherein the as-spun polyester yarn is one which has been spun at a spinning speed of at least 4,000 m/min, and the yarn is heat-treated at a temperature of at least 190° C. in a twisted state without substantial stretching, cooled to a temperature lower than the heat treatment temperature and then subjected to the false twisting treatment.

12. A process for producing a false-twisted polyester yarn according to claim 10, wherein the heat treatment is carried out for 0.2 to 1.0 second.

13. A process for producing a false-twisted polyester yarn according to claim 10, wherein the twist number at the heat treatment is at least 3% of the twist number at the false twisting treatment.

14. A process for producing a false-twisted polyester yarn according to claim 9, wherein cooling is natural cooling carried out at a temperature of 20 15° C. for the period of A satisfying the following formula:

$$A\ (\text{sec}) \geqq \frac{7 - V}{4(V - 2.0)}$$

wherein V stands for the spinning speed (km/min).

15. A process for producing a false-twisted polyester yarn according to claim 9, wherein cooling is forced cooling.

16. A process for producing a false-twisted polyester yarn according to claim 2, wherein the heat treatment is carried out at a feed ratio of 0 to S% in which S stands for the shrinkage (S>0) (%) in boiling water of the as-spun polyester yarn.

17. A process for producing a false-twisted polyester yarn according to claim 2, wherein an oiling agent is applied to the polyester yarn after the heat treatment.

18. A process for producing a false-twisted polyester yarn according to claim 8, wherein the heat treatment is carried out by passing the as-spun polyester yarn through a tubular or slit heater having a surface temperature of at least 250° C. for a time of at least 0.4 second without contacting the yarn with the heater.

19. A process for producing a false-twisted polyester yarn according to claim 2, wherein the false twisting treatment is carried out by using a false-twisting heater maintained at a temperature of lower than the temperature of the polyester yarn at the heat treatment.

20. A process for producing a false-twisted polyester yarn according to claim 10, wherein the false twisting treatment is carried out by using a false twisting heater maintained at a temperature of not higher than 200° C. while contacting the yarn with the false twisting heater.

21. A process for producing a false-twisted polyester yarn according to claim 4, wherein the as-spun polyester yarn is one which has been spun at a spinning speed of at least 4,000 m/min and the fiber feed ratio at the heat treatment is in the range of from +20% to −20%.

22. A process for producing a false-twisted polyester yarn according to claim 2, wherein the mean birefringence index ($\Delta n$) of the as-spun polyester yarn is at least $15\times10^{-3}$ but less than $50\times10^{-3}$ and the fiber feed ratio at the heat treatment is in the range of from −5% to −200%.

23. A process for producing a false-twisted polyester yarn according to claim 2, wherein the as-spun polyester yarn is one which has been spun at a spinning rate of at least 2,500 m/min but less than 4,000 m/min and the fiber feed ratio at the heat treatment is in the range of from −5% to −200%.

24. A process for producing a false-twisted polyester yarn according to claim 2, wherein the heat treatment is carried out in an atmosphere of super-heated steam or a mixture of super-heated steam and hot air, maintained at a temperature of from (230–50Z)° C. to (290–50Z)° C. in which Z represents the mole fraction of steam.

* * * * *

UNITED STATES PATENT AND TRADEMARK OFFICE

CERTIFICATE OF CORRECTION

PATENT NO. : No. 4,539,805
DATED : September 10, 1985
INVENTOR(S) : Norio UKAI et al.

It is certified that error appears in the above-identified patent and that said Letters Patent is hereby corrected as shown below:

IN THE ABSTRACT

Line 4, change "birefrigence" to -- birefringence -- .

IN THE CLAIMS;

Claim 3, line 4, after "50 x $10^{-3}$", add -- to 150 x $10^{-3}$ -- .

Signed and Sealed this
Tenth Day of June 1986

[SEAL]

*Attest:*

*Attesting Officer*

DONALD J. QUIGG
*Commissioner of Patents and Trademarks*